US008047896B2

(12) United States Patent
Takahashi et al.

(10) Patent No.: US 8,047,896 B2
(45) Date of Patent: Nov. 1, 2011

(54) POLISHING APPARATUS, POLISHING METHOD, AND PROCESSING APPARATUS

(75) Inventors: Tamami Takahashi, Tokyo (JP); Kenya Ito, Tokyo (JP); Masaya Seki, Tokyo (JP); Hiroaki Kusa, Tokyo (JP)

(73) Assignee: Ebara Corporation, Tokyo (JP)

( * ) Notice: Subject to any disclaimer, the term of this patent is extended or adjusted under 35 U.S.C. 154(b) by 350 days.

(21) Appl. No.: 12/310,364

(22) PCT Filed: Oct. 2, 2007

(86) PCT No.: PCT/JP2007/069641

§ 371 (c)(1),
(2), (4) Date: Feb. 23, 2009

(87) PCT Pub. No.: WO2008/041778

PCT Pub. Date: Apr. 10, 2008

(65) Prior Publication Data

US 2009/0325465 A1 Dec. 31, 2009

(30) Foreign Application Priority Data

Oct. 4, 2006 (JP) ..... 2006-273331

(51) Int. Cl.
*B24B 49/00* (2006.01)
*B24B 21/20* (2006.01)

(52) U.S. Cl. ..... 451/6; 451/8; 451/44; 451/311

(58) Field of Classification Search ..... 451/5, 6, 451/8–11, 59, 296, 299, 303, 304, 306, 307, 451/311, 44

See application file for complete search history.

(56) References Cited

U.S. PATENT DOCUMENTS 5,951,384 A * 9/1999 Morioka et al. ..... 451/303
7,066,787 B2 * 6/2006 Nakanishi et al. ..... 451/6
7,108,582 B2 * 9/2006 Sato et al. ..... 451/11
7,682,225 B2 * 3/2010 Hongo et al. ..... 451/303

FOREIGN PATENT DOCUMENTS

JP 62-213955 9/1987

(Continued)

OTHER PUBLICATIONS

International Search Report mailed Dec. 25, 2007 for International Application No. PCT/JP2007/069641.

*Primary Examiner* — Dung Van Nguyen
(74) *Attorney, Agent, or Firm* — Wenderoth, Lind & Ponack, L.L.P.

(57) ABSTRACT

The present invention provides a polishing apparatus and a polishing method capable of calculating outside diameters of rolls of a polishing tape on a polishing-tape supply reel and a polishing-tape recovery reel and capable of calculating a remaining amount of the polishing tape and a consumption of the polishing tape from the outside diameters of the rolls. This polishing apparatus includes a polishing-tape supply reel (46), a polishing head (44), a polishing-tape drawing-out mechanism G1, and a polishing-tape supply and recovery mechanism (45) configured to recover the polishing tape (43) from the polishing-tape supply reel (46) via the polishing head (44). The polishing-tape supply and recovery mechanism (45) includes a motor Mb adapted to apply a torque to the polishing-tape supply reel (46) so as to exert a predetermined tension on the polishing tape (43) traveling through the polishing head (44), and a rotation angle detector REa adapted to detect a rotation angle of the polishing-tape supply reel (46).

12 Claims, 11 Drawing Sheets

FOREIGN PATENT DOCUMENTS

| | | |
|---|---|---|
| JP | 62-215845 | 9/1987 |
| JP | 63-2661 | 1/1988 |
| JP | 3-131464 | 6/1991 |
| JP | 2003-240673 | 8/2003 |
| WO | 2006/112531 | 10/2006 |

* cited by examiner

POLISHING APPARATUS, POLISHING METHOD, AND PROCESSING APPARATUS

TECHNICAL FIELD

The present invention relates to a polishing apparatus and a polishing method for polishing a workpiece by bringing a polishing tape into contact with a workpiece while providing relative movement between the workpiece and the polishing tape, and more particularly to a polishing apparatus and a polishing method for polishing a periphery of a substrate, such as a semiconductor wafer, using a polishing tape. The present invention also relates to a processing apparatus using such a polishing apparatus.

BACKGROUND ART

Conventionally, a polishing apparatus of this type includes a polishing-tape supply reel mechanism, a polishing head, a polishing-tape recovery reel mechanism, and a polishing-tape supply and recovery mechanism for recovering a polishing tape supplied from the polishing-tape supply reel mechanism via the polishing head to the polishing-tape recovery reel mechanism. The polishing tape is brought into contact with a periphery of a workpiece, such as a semiconductor wafer, while traveling through the polishing head. The workpiece is polished by relative movement between the polishing tape and the workpiece.

FIG. 1 is a schematic view showing the above-mentioned polishing apparatus, and FIG. 2 is a plan view showing the polishing-tape supply and recovery mechanism of the polishing apparatus. As shown in the drawings, a polishing apparatus 100 includes a polishing-tape supply reel mechanism 101, a polishing head 103, and a polishing-tape recovery reel mechanism 102. A polishing tape 105 is supplied from the polishing-tape supply reel mechanism 101 via a guide roller 104 to the polishing head 103. The polishing tape 105 travels through the polishing head 103 to a guide roller 106, and is wound and recovered by the polishing-tape recovery reel mechanism 102. A periphery of a substrate (e.g., a semiconductor wafer) W, held by a substrate holding stage 120, is brought into contact with the polishing tape 105 traveling through the polishing head 103, and the periphery of the substrate W is polished by relative movement between the polishing tape and the workpiece.

The polishing-tape supply reel mechanism 101 and the polishing-tape recovery reel mechanism 102 are driven by a drive motor 107 and a drive motor 108, respectively. The drive motor 107 and the drive motor 108 are provided with a rotary encoder 109 and a rotary encoder 110 for detecting a rotation angle of the drive motor 107 and the drive motor 108, respectively. A rotational torque of the drive motor 107 and a rotational torque of the drive motor 108 are controlled so as to maintain a constant tension exerted on the polishing tape 105. The polishing tape 105 is contained as a polishing-tape roll 111 between a reel plates 114*a* and 114*b* of the polishing-tape supply reel mechanism 101. The recovered polishing tape 105 is contained as a polishing-tape roll 111 between a reel plates 115*a* and 115*b* of the polishing-tape recovery reel mechanism 102.

As shown in FIG. 3, the polishing tape 105 is wound as the polishing-tape roll 111 on a cylindrical core 101*a* of the polishing-tape supply reel mechanism 101. This core 101*a* has an inside diameter Dci and an outside diameter Dco. Since the new polishing-tape supply reel mechanism 101 supplies the polishing tape 105, the outside diameter of the roll 111 is gradually decreased. On the other hand, since the polishing-tape recovery reel mechanism 102 winds the polishing tape 105, the outside diameter of the roll 111 is gradually increased. If the drive motors 107 and 108 keep their rotational torque constant, the tension exerted on the polishing tape 105 changes, as the outside diameter of the polishing-tape roll 111 changes as the result of consumption of the polishing tape 105. The tension of the polishing tape 105 acts as a polishing load between the polishing tape 105 and the substrate W, i.e., a workpiece to be polished. Therefore, in order to keep the polishing load constant irrespective of the consumption of the polishing tape 105, it is necessary to keep the tension of the polishing tape 105 constant regardless of a change in outside diameter of the roll 111 of the polishing tape 105. Thus, it is necessary to control an output of the drive motor 107 and an output of the drive motor 108 in accordance with the change in outside diameter of the roll 111 of the polishing tape 105, so as to control the rotational torque to be exerted on the polishing-tape supply reel mechanism 101 and the polishing-tape recovery reel mechanism 102.

FIG. 4 shows a conventional mechanism of detecting the outside diameter of the roll 111 of the polishing tape 105 on the polishing-tape supply reel mechanism 101 and the polishing-tape recovery reel mechanism 102. As shown in FIG. 4, an outside-diameter sensor 112 and an outside-diameter sensor 113, as a pair of laser sensors, are provided so as to interpose the polishing-tape roll 111 on the polishing-tape supply reel mechanism 101 therebetween. The outside-diameter sensor 112 is a light-emitting sensor, and the outside-diameter sensor 113 is a light-receiving sensor. A distance of light interruption by the roll 111 of the polishing tape 105 is detected and the distance is converted into the outside diameter of the polishing tape 105. In the example shown in FIG. 4, the outside-diameter sensors 112 and 113 are provided so as to measure only the outside diameter of the roll 111 of the polishing tape 105 on the polishing-tape supply reel mechanism 101.

In this method of detecting the outside diameter of the roll 111 of the polishing tape 105, it is necessary to provide the outside-diameter sensors for both the polishing-tape supply reel mechanism 101 and the polishing-tape recovery reel mechanism 102. When using an optical sensor like the conventional technique, it is necessary to adjust, for each of the reels, a relational expression for converting the amount of light interruption, from the light emitting to the light receiving, into the outside diameter of the polishing-tape roll 111. In addition, since the outside-diameter sensors 112 and 113 are provided near the polishing-tape supply reel mechanism 101 and the polishing-tape recovery reel mechanism 102, the outside-diameter sensors 112 and 113 could hinder replacement operations of the polishing tape 105.

DISCLOSURE OF INVENTION

The present invention has been made in view of the above drawbacks. It is therefore an object of the present invention to provide a polishing apparatus, a polishing method, and a processing apparatus using the polishing apparatus capable of calculating outside diameters of rolls of a polishing tape on a polishing-tape supply reel and a polishing-tape recovery reel and capable of calculating a remaining amount of the polishing tape and a consumption of the polishing tape from the outside diameters of the rolls.

In order to solve the above drawbacks, one aspect of the present invention is a polishing apparatus for polishing a workpiece by providing relative movement between a polishing tape and the workpiece. This apparatus includes a polishing-tape supply reel, a polishing head, a polishing-tape drawing-out mechanism, and a polishing-tape supply and recovery mechanism configured to recover the polishing tape from the polishing-tape supply reel via the polishing head. The polishing tape is brought into contact with the workpiece while traveling through the polishing head. The polishing-tape supply and recovery mechanism includes a motor adapted to apply a torque to the polishing-tape supply reel so as to exert a predetermined tension on the polishing tape traveling through the polishing head, and a rotation angle detector adapted to detect a rotation angle of the polishing-tape supply reel.

According to the present invention, a remaining amount of the polishing tape can be detected from the rotation angle of the polishing-tape supply reel detected by the rotation angle detector.

In a preferred aspect of the present invention, the polishing apparatus further includes a polishing-tape recovery reel for winding and recovering the polishing tape drawn out by the polishing-tape drawing-out mechanism.

According to the present invention, the outside diameter of the roll of the polishing tape is calculated from the rotation angle of the polishing-tape supply reel when the polishing-tape drawing-out mechanism draws out the polishing tape by the predetermined length. The output torque of the motor that rotates the polishing-tape drawing-out mechanism is controlled, so that the tension of the polishing tape can be kept constant.

Another aspect of the present invention is a polishing apparatus for polishing a workpiece by providing relative movement between a polishing tape and the workpiece. This apparatus includes a polishing-tape supply reel, a polishing head, a polishing-tape drawing-out mechanism, and a polishing-tape supply and recovery mechanism configured to recover the polishing tape from the polishing-tape supply reel via the polishing head. The polishing tape is brought into contact with the workpiece while traveling through the polishing head. The polishing-tape supply and recovery mechanism includes a motor adapted to apply a torque to the polishing-tape supply reel so as to exert a predetermined tension on the polishing tape traveling through the polishing head, and a sensor configured to detect an end mark on the polishing tape. The sensor is located near the polishing-tape supply reel.

According to the present invention, since the sensor is provided for detecting the end mark on the polishing tape, the remaining amount of the polishing tape can be accurately determined upon detection of the end mark by the sensor.

Another aspect of the present invention is a polishing method including drawing out a polishing tape from a polishing-tape supply reel by a predetermined length, bringing the polishing tape into contact with a workpiece while the polishing tape travels through a polishing head, providing relative movement between the polishing tape and the workpiece to polish the workpiece, recovering the polishing tape via the polishing head, before and after the drawing out of the polishing tape by the predetermined length, detecting a rotation angle of the polishing-tape supply reel, and calculating from the rotation angle an outside diameter of a roll of the polishing tape on the polishing-tape supply reel.

In a preferred aspect of the present invention, the drawing out of the polishing tape by the predetermined length and the calculating of the outside diameter of the roll of the polishing tape on the polishing-tape supply reel are performed before or after the polishing of the workpiece.

In a preferred aspect of the present invention, the polishing method further includes, based on the calculated outside diameter of the roll of the polishing tape on the polishing-tape supply reel, controlling a torque of a motor that drives the polishing-tape supply reel and controlling a torque of a motor that drives the polishing-tape drawing-out mechanism so as to control a tension exerted on the polishing tape.

According to the present invention, the tension exerted on the polishing tape can be kept constant.

In a preferred aspect of the present invention, the polishing method further includes calculating a remaining amount of the polishing tape from the calculated outside diameter of the roll of the polishing tape on the polishing-tape supply reel.

According to the present invention, the remaining amount of the polishing tape can be calculated without using a dedicated sensor.

In a preferred aspect of the present invention, the polishing method further includes, from the calculated remaining amount of the polishing tape, calculating the number of workpieces that can be polished without replacement of the polishing tape, so as not to polish the workpieces more than the number calculated.

According to the present invention, all of the workpieces (which have been fed to the polishing apparatus) can be polished. In other words, the workpieces, which are the object of polishing, can be polished using the polishing tape remaining.

In a preferred aspect of the present invention, the polishing method further includes, from the calculated outside diameter of the roll of the polishing tape on the polishing-tape supply reel and the rotation angle of the polishing-tape supply reel detected before and after the polishing of the workpiece, determining a length of the polishing tape supplied and a length of the polishing tape recovered before or after the polishing of the workpiece.

According to the present invention, the length of the polishing tape supplied and the length of the polishing tape recovered can be detected without using a sensor. The length of the polishing tape supplied and the length of the polishing tape recovered are equal to each other, as long as the polishing tape does not stretch. Therefore, by comparing the length supplied and the length recovered, it is possible to determine whether the polishing tape is properly supplied and recovered during polishing. This also can be used to detect the failure of the apparatus.

Another aspect of the present invention is a polishing method including drawing out a polishing tape from a polishing-tape supply reel by a predetermined length, bringing the polishing tape into contact with a workpiece while the polishing tape travels through a polishing head, providing relative movement between the polishing tape and the workpiece to polish the workpiece, recovering the polishing tape via the polishing head, and detecting an end mark on the polishing tape that is being drawn out.

According to the present invention, the end mark can be detected regardless of the polishing operations or the polishing-tape length that could change depending on polishing conditions. Upon detection of the end mark, the remaining amount of the polishing tape can be accurately determined.

Another aspect of the present invention is a processing apparatus for performing several processes including polishing of a workpiece. This apparatus includes a workpiece holding stage disposed in a housing and configured to hold a workpiece, and at least one polishing apparatus as described above for polishing a periphery of the workpiece.

According to the present invention, the processing apparatus can perform excellent processes including polishing of the periphery of the workpiece. In a case of using plural polishing apparatuses, the remaining amount of the polishing tape in one of the polishing apparatus can be used to determine a processing capability of another. From the calculated remaining amount of the polishing tape, it is possible to calculate the number of workpieces that can be polished without replacement of the polishing tape, so as not to process the workpieces more than the number calculated. Therefore, all of the workpieces (which have been fed to the polishing apparatus) can be polished. In other words, the workpieces, which are to be polished, can be polished using the remaining polishing tape.

BEST MODE FOR CARRYING OUT THE INVENTION

Figure 1:
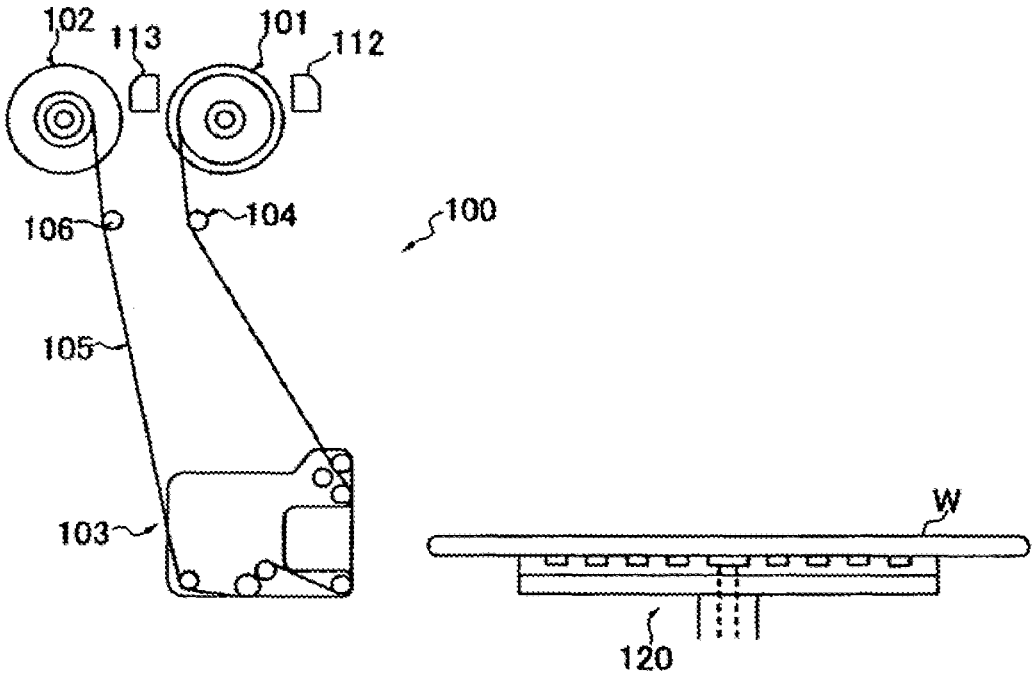
FIG. 1 PRIOR ART
FIG. 1 is a view showing schematic structures of a conventional polishing apparatus.
Figure 2:
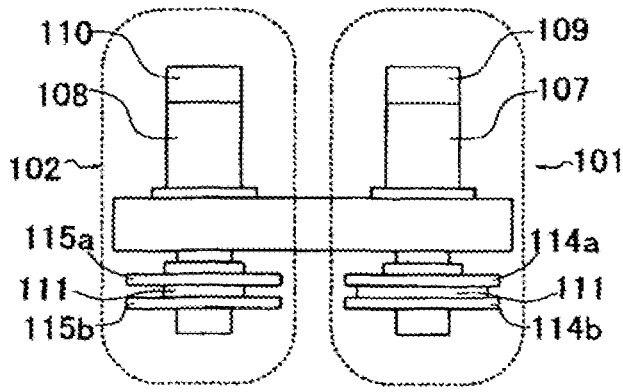
FIG. 2 PRIOR ART
FIG. 2 is a view showing structures of a polishing-tape supply and recovery mechanism of the conventional polishing apparatus.
Figure 3:
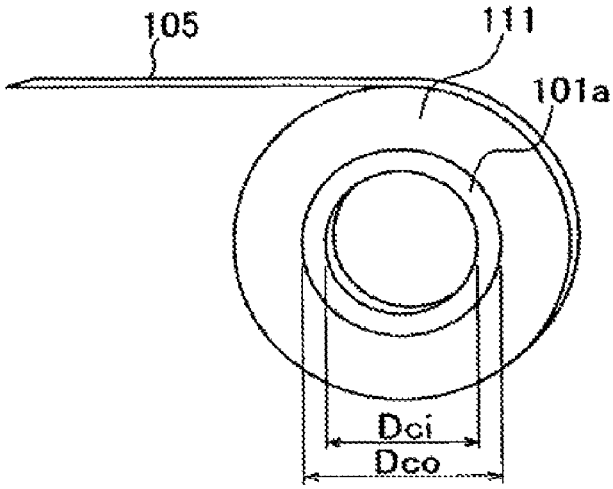
FIG. 3 PRIOR ART
FIG. 3 is a view showing a core of a polishing-tape supply reel and a roll of a polishing tape.
Figure 4:
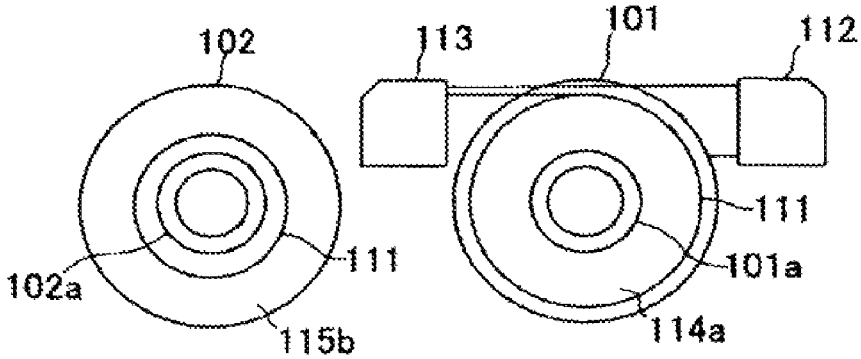
FIG. 4 PRIOR ART
FIG. 4 is a view showing structures for detecting an outside diameter of the roll of the polishing tape of the conventional polishing-tape supply reel.
Figure 5A:
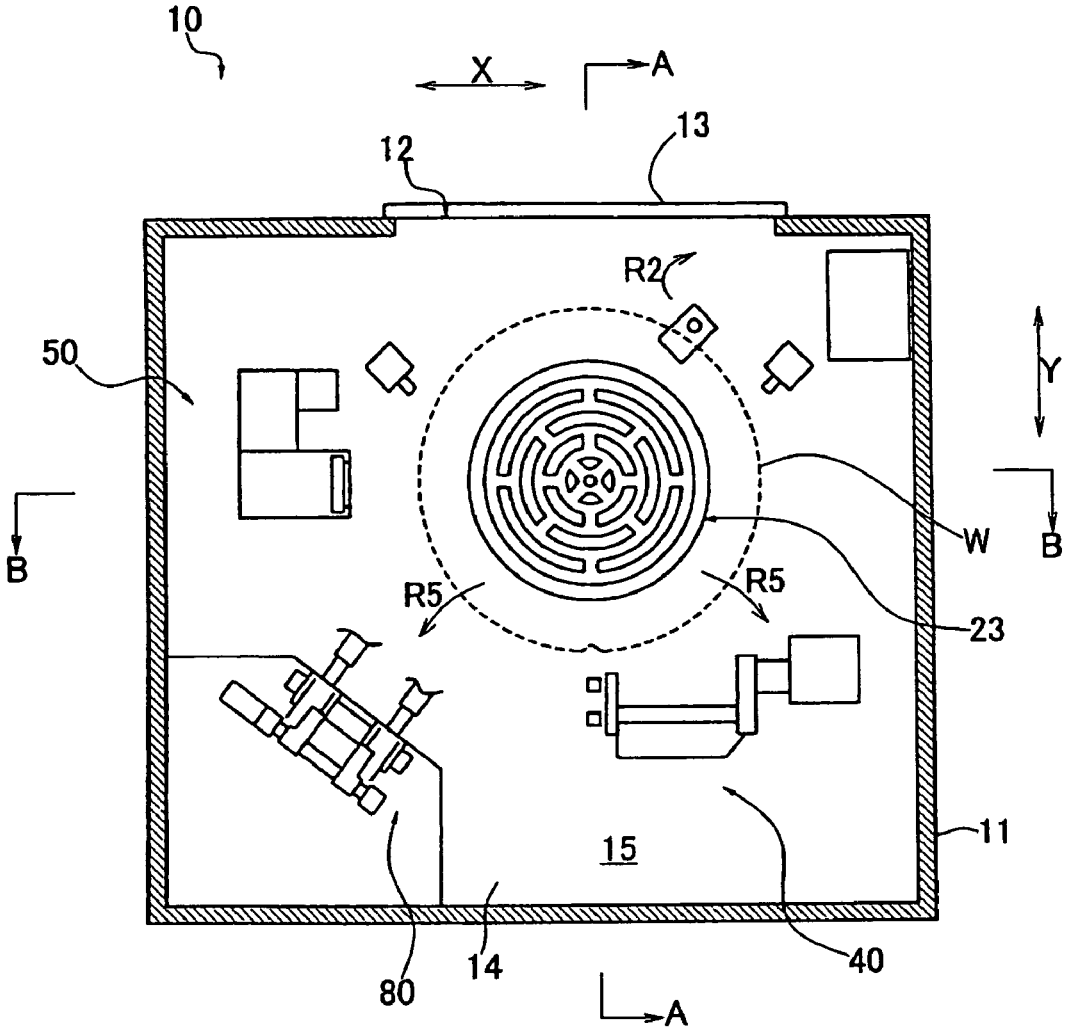
FIGS. 5A and 5B are horizontal cross-sectional views showing a structural example of a substrate processing apparatus using a polishing apparatus according to the present invention.
Figure 5B:
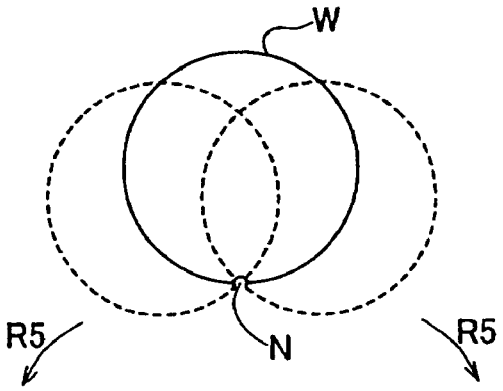
Figure 6:
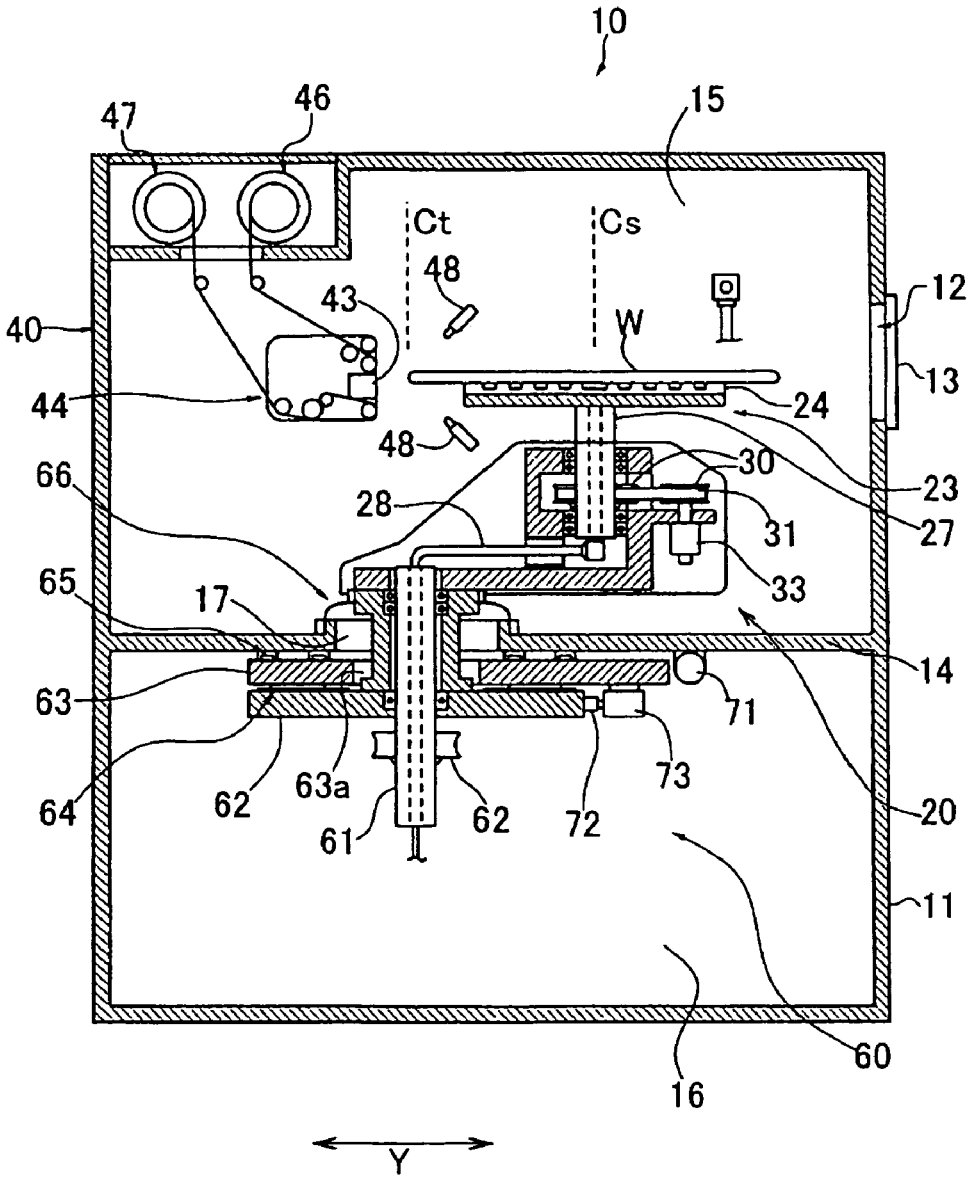
FIG. 6 is a cross-sectional view taken along line A-A in FIG. 5A.
Figure 7:
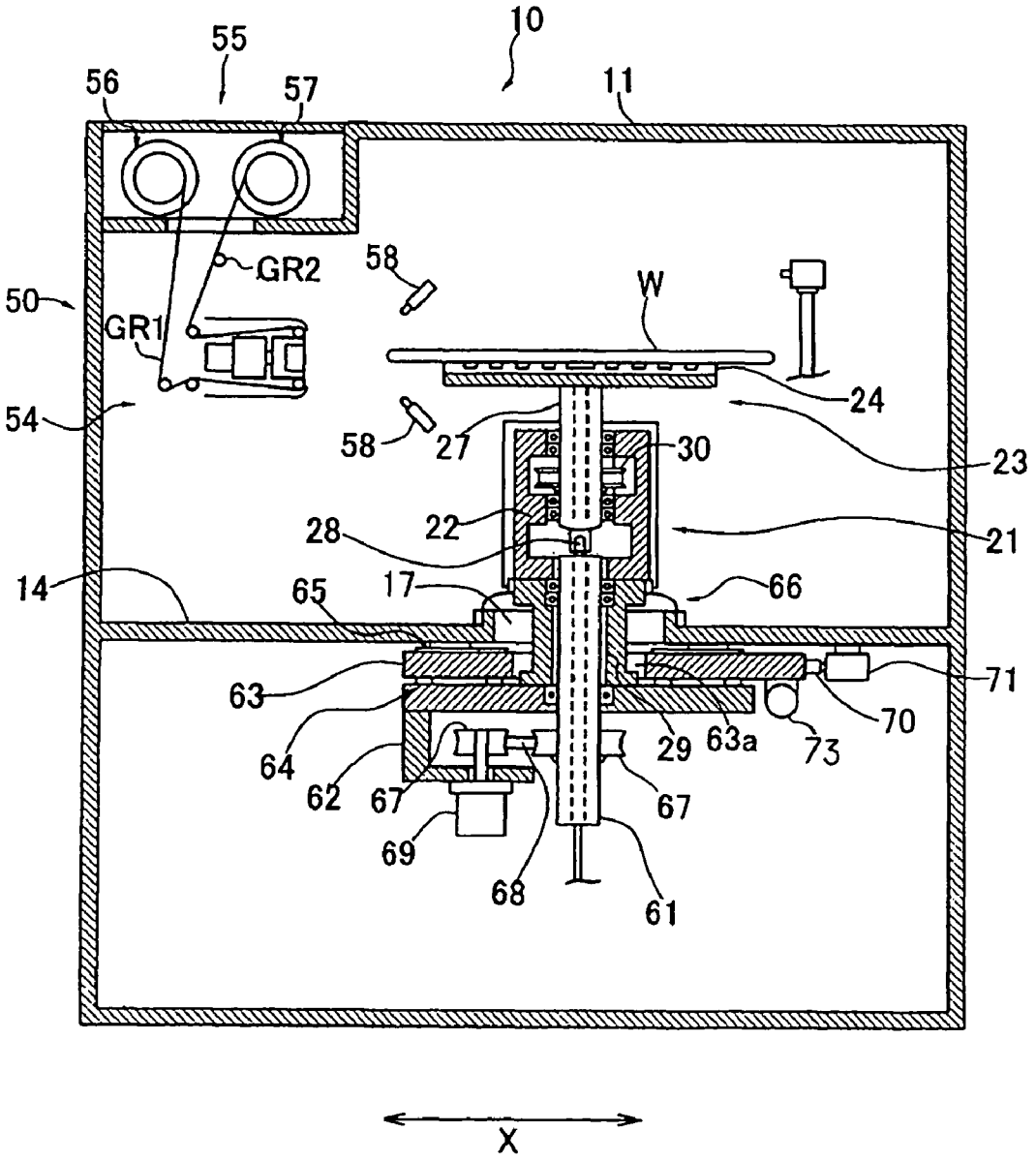
FIG. 7 is a cross-sectional view taken along line B-B in FIG. 5A.

Embodiments of the present invention will be described below with reference to the drawings. FIG. 5A through FIG. 7 are views showing structural examples of a substrate processing apparatus using a polishing apparatus according to the present invention. Specifically, FIGS. 5A and 5B are horizontal cross-sectional views showing the substrate processing apparatus, FIG. 6 is a cross-sectional view taken along line A-A in FIG. 5A, and FIG. 7 is a cross-sectional view taken along line B-B in FIG. 5A. A substrate processing apparatus 10 includes a substrate holding stage unit 20 having a substrate holding stage 23 for holding a substrate, a substrate holding stage moving mechanism 60 for moving the substrate holding stage unit 20 in a direction parallel to a surface of the substrate holding stage 23, and two or more polishing sections for polishing a periphery of a substrate W held by the substrate holding stage 23. In this embodiment, a semiconductor wafer is used as the substrate W. However, the substrate W is not limited to the semiconductor wafer.

In this example shown in the drawings, the substrate processing apparatus has two polishing sections, one of which is a notch polishing section 40 for polishing a notch of the substrate W held by the substrate holding stage 23, and another is a bevel polishing section 50 for polishing a bevel (circumferential edge portion) of the substrate W held by the substrate holding stage 23. The substrate processing apparatus may have more than two polishing sections including plural notch polishing sections and plural bevel polishing sections. For example, the substrate processing apparatus may include notch polishing sections and bevel polishing sections each providing a first polishing unit for performing rough polishing, a second polishing unit for performing finish polishing, and a third polishing unit for performing cleaning.

A housing 11 is partitioned by a partition plate 14 into two spaces. The upper space provides an upper chamber 15, and the lower space provides a lower chamber 16. The substrate holding stage unit 20, the notch polishing section 40, and the bevel polishing section 50 are located in the upper chamber 15, and the substrate holding stage moving mechanism 60 is located in the lower chamber 16.

A side surface of the upper chamber 15 has an opening 12. This opening 12 is closed by a shutter 13 which is driven by a cylinder (not shown). The substrate W is transferred into and from the housing 11 through the opening 12. Transferring of the substrate W into and from the housing 11 is performed by a known substrate transfer device, such as a transfer robot hand (which will be discussed later). By closing the opening 12 of the housing 11 with the shutter 13, the internal space of the housing 11 is completely isolated from the external space. Therefore, during polishing, cleanliness and air tightness in the housing 11 are maintained. Consequently, contamination of the substrate W due to the external space of the housing 11 and contamination of the external space during polishing due to a polishing liquid and particles from the internal space of the housing 11 can be prevented.

The substrate processing apparatus 10 further includes a substrate chuck mechanism 80 for placing the substrate W, which has been transferred into the housing 11, onto the substrate holding stage 23 and for removing the substrate W, which is held by the substrate holding stage 23, from the substrate holding stage 23.

Figure 8A:
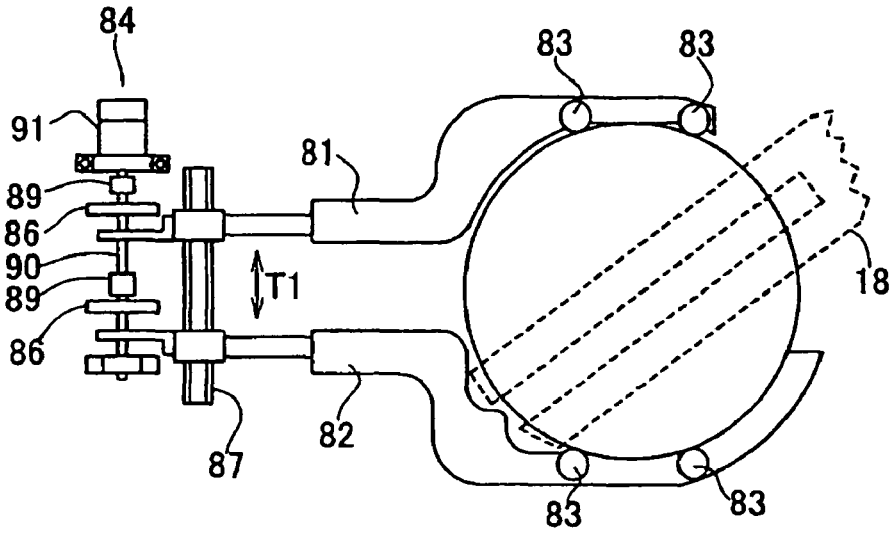
FIGS. 8A and 8B are views each showing structures of a substrate-chuck mechanism of the polishing apparatus according to the present invention.

The substrate chuck mechanism 80 has, as shown in FIG. 8A, a first chuck hand 81 having two or more pins 83, and a second chuck hand 82 having two or more pins 83. The substrate chuck mechanism 80 further includes a chuck-hand opening and closing mechanism 84 for opening and closing the first and second chuck hands 81 and 82 in directions (indicated by arrows T1) parallel to a surface of the substrate W held by the substrate holding stage 23, and a chuck-hand moving mechanism 85 for reciprocating the first and second chuck hands 81 and 82 in directions (indicated by arrows T2) perpendicular to the surface of the substrate W held by the substrate holding stage 23. When the first and second chuck hands 81 and 82 are closed, the pins 83 of the first and second chuck hands 81 and 82 are brought into contact with a circumferential edge of the substrate W to hold the substrate W.

As shown in FIG. 8A, the chuck-hand opening and closing mechanism 84 includes a ball screw 90 engaging the first and second chuck hands 81 and 82, a servomotor 91 for driving the ball screw 90, and a linear guide 87 extending through the first and second chuck hands 81 and 82 in the directions indicated by the arrows T1. Guides 86 and couplings 89 are connected to the ball screw 90. As the servomotor 91 is energized, the first and second chuck hands 81 and 82 are opened and closed, i.e., moved in the directions indicated by the arrows T1. When the first and second chuck hands 81 and 82 hold the substrate W therebetween, the center of the substrate W is located on the center of the substrate holding stage 23 (i.e., on a rotational axis Cs of the substrate holding stage 23, which will be described later).

Figure 8B:
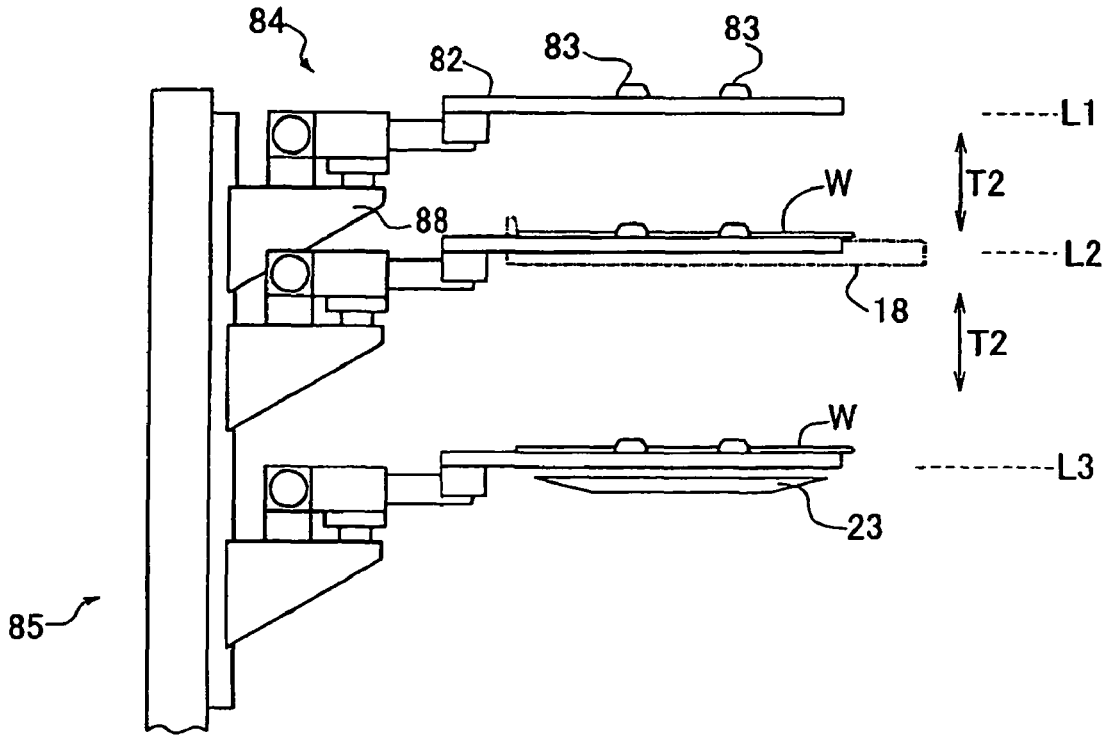
Figure 9:
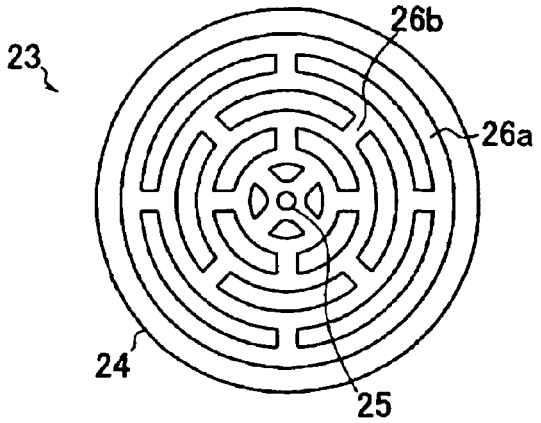
FIG. 9 is a view showing structures of a substrate-holding stage of the polishing apparatus according to the present invention.

As shown in FIG. 8B, the chuck-hand moving mechanism includes an elevating base 88 supporting the first and second chuck hands 81 and 82. This elevating base 88 engages a ball screw (not shown) coupled to a servomotor (not shown), so that the servomotor drives the ball screw to thereby reciprocate the first and second chuck hands 81 and 82 in the directions (indicated by arrows T2) perpendicular to the surface of the substrate holding stage 23. In FIG. 8B, reference numeral L1 represents an idling position, reference numeral L2 represents a substrate-transfer position (where the first and second chuck hands 81 and 82 hold the substrate W on the transfer robot hand 18, or place the substrate W onto the transfer robot hand 18), and reference numeral L3 represents a substrate placement position (where the substrate W is placed onto the substrate holding stage 23, or the first and second chuck hands 81 and 82 hold the substrate W held by the substrate holding stage 23).

As shown in FIG. 5A through FIG. 7, the substrate holding stage unit 20 further includes a substrate holding stage rotating mechanism for rotating the substrate holding stage 23, and a stage swinging mechanism for swinging the substrate holding stage 23 with respect to the notch of the substrate W held by the substrate holding stage 23 (i.e., reciprocating the substrate holding stage 23 in directions as indicated by arrows R5) in the same plane as the surface of the substrate W held by the substrate holding stage 23.

The substrate holding stage 23 has, as shown in FIG. 5A through FIG. 7 and FIG. 9, a flat surface with one or plural suction hole 25 (one in the example in the drawings) that is in fluid communication with a vacuum pump (not shown). An elastic pad 24 with a constant height (thickness) is attached to this surface so as not to close the suction hole 25. The substrate W is placed onto this pad 24. The suction hole 25 communicates with the external vacuum pump (not shown) via a pipe 28 rotatably mounted on a lower end of a hollow shaft 27 and via a hollow shaft 61.

An upper surface of the pad 24 has grooves 26*a* and 26*b* that are in fluid communication with the suction hole 25. Preferably, the upper surface of the pad 24 has annular grooves 26*a* which are concentrically arranged and plural grooves 26*b* connecting the annular grooves 26*a* to each other. These annular grooves 26*a* and the radial grooves 26*b* communicate with the above-mentioned vacuum pump. When the substrate W is placed onto the pad 24, the grooves 26*a* and 26*b* are sealed hermetically by a rear surface of the substrate W. In this state, the vacuum pump operates, so that the substrate W is sucked and held on the pad 24. In this manner, the substrate W is attracted and held by the substrate holding stage 23 without deformation (flexion).

After being held by the first and second chuck hands 81 and 82 as described above, the substrate W is placed onto the pad 24 on the substrate holding stage 23 by the chuck-hand moving mechanism 85. Then, the chuck hands 81 and 82 are opened by the chuck-hand opening and closing mechanism 84, and simultaneously the vacuum pump is driven to reduce pressure in a space at a rear-surface side of the substrate W (i.e., internal spaces of the grooves 26*a* and 26*b* formed on the upper surface of the pad 24), whereby the substrate W is pressed against the pad 24 and slightly sinks. In this manner, the substrate W is securely attracted and held by the substrate holding stage 23.

On the other hand, the substrate W, which is being attracted and held by the substrate holding stage 23, is held by the first and second chuck hands 81 and 82, and is then elevated upwardly by the chuck hand moving mechanism 85. The operation of the vacuum pump is stopped when the substrate W is slightly elevated (by a distance of 0.5 mm to 1.0 mm), whereby the vacuum attraction is terminated. With these operations, when the substrate W is released from the substrate holding stage 23, a large releasing force (which is required for removing the substrate W from the substrate holding stage 23) is not applied to the substrate W in an instant. Consequently, the substrate W can be released from the substrate holding stage 23 without deformation and any damages.

As shown in FIGS. 6 and 7, the substrate holding stage rotating mechanism includes the shaft 27 coupled to a rear side of the substrate holding stage 23 in concentric arrangement with the rotational axis Cs, and a motor 33 coupled to the shaft 27 via pulleys 30 and a belt 31. The shaft 27 is rotatably supported by bearings on a support member 22 of a unit body 21. The motor 33 is fixed to the support member 22. The substrate holding stage 23 is driven by the motor 33 so as to rotate about the shaft 27.

The stage swinging mechanism is for swinging and reciprocating the substrate holding stage 23 in the same plane as the surface of the substrate holding stage 23. This stage swinging mechanism includes the shaft 61 and a motor 69 coupled to the shaft 61 via pulleys 67 and a belt 68. The shaft 61 is located away from the rotational axis Cs of the substrate holding stage 23 by a distance substantially equal to a radius of the substrate W. The shaft 61 extends through an aperture 17 of the partition plate 14 of the housing 11, and is fixed to a lower surface of the support member 22 of the unit body 21 of the substrate holding stage unit 20. The shaft 61 is rotatably supported by bearings on a hollow bearing base 29. A lower surface of the bearing base 29 is fixed to a support plate 62 located below the partition plate 14 of the housing 11, and an upper surface of the bearing base 29 is in contact with the lower surface of the unit body 21 to support this unit body 21.

The motor 69 is fixed to the support plate 62. When energizing the motor 69, the substrate holding stage unit 20 is swung and reciprocated with respect to an offset position, i.e., a swing axis Ct, in the same plane as the surface of the substrate holding stage 23 (in the directions as indicated by the arrows R5 in FIG. 5A and FIG. 5B). Preferably, the stage swinging mechanism swings and reciprocates the substrate holding stage 23, holding the substrate W, with respect to the notch of the substrate W in the same plane as the surface of the substrate holding stage 23.

As shown in FIG. 6 and FIG. 7, the substrate holding stage moving mechanism 60 is provided for moving the support plate 62, to which the bearing base 29 of the stage swinging mechanism is fixed, in directions parallel to the surface of the substrate holding stage 23.

The above-mentioned substrate holding stage moving mechanism 60 includes, as shown in the drawings, a movable plate 63 located between the partition plate 14 of the housing 11 and the support plate 62, and a motor 71 for driving a ball screw 70 coupled to the movable plate 63. The movable plate 63 is coupled to the partition plate 14 via linear guides 65 that allow the movable plate 63 to move in first directions (i.e., directions as indicated by arrows X in FIG. 5A and FIG. 7). The motor 71 is for moving the movable plate 63 in the directions indicated by the arrows X. This motor 71 is fixed to the lower surface of the partition plate 14. The movable plate 63 has an aperture 63*a*, and the bearing base 29 extends through this aperture 63*a*. The support plate 62 is coupled to a lower surface of the movable plate 63 via linear guides 64 that allow the support plate 62 to move in directions perpendicular to the first directions X (i.e., directions as indicated by arrows Y in FIG. 5A and FIG. 6). A motor 73 is fixed to the movable plate 63. This motor 73 drives a ball screw 72 to cause the support plate 62 to move in the directions as indicated by the arrows Y. When the motor 71 is energized, the ball screw 70, which is coupled to the movable plate 63, is rotated to move the movable plate 63 in the directions X.

When the motor 73, which is fixed to the movable plate 63, is energized, the ball screw 72, which is coupled to the support plate 62, is rotated to move the support plate 62 relative to the movable plate 63 in the directions Y. The movable range of the substrate holding stage unit 20 in the directions X and Y depends on a size of the aperture 17 formed in the partition plate 14 and a size of the aperture 63*a* formed in the movable plate 63. Therefore, by providing larger apertures 17 and 63*a* at a design phase of the substrate processing apparatus 10, the substrate holding stage unit 20 can move in a larger range.

Figure 10A:
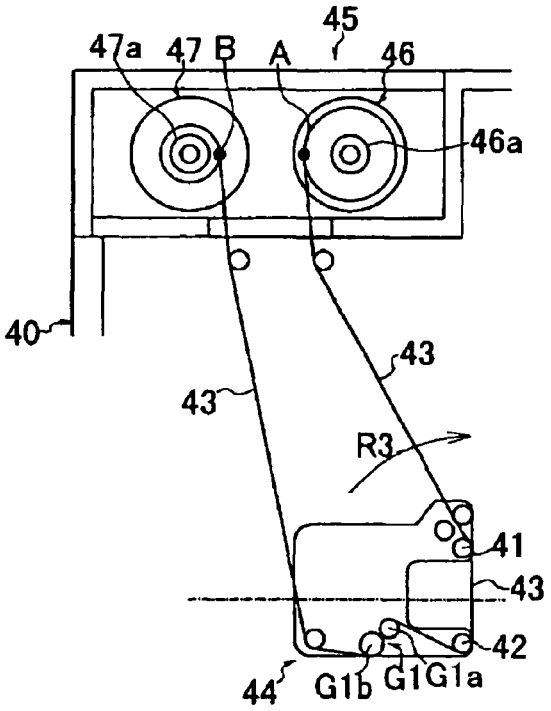
FIGS. 10A and 10B are views each showing schematic structures of the polishing apparatus according to the present invention.

The notch polishing section 40 is the polishing apparatus according to the present invention. As shown in FIG. 6 and FIG. 10A, the notch polishing section 40 includes a polishing-tape supply reel 46, a polishing head 44, and a polishing-tape recovery reel 47. The notch polishing section 40 further includes a polishing-tape supply and recovery mechanism 45 for recovering a polishing tape 43, supplied from the polishing-tape supply reel 46, to the polishing-tape recovery reel 47 via the polishing head 44. The notch of the substrate W (i.e., a workpiece to be polished) is brought into contact with the polishing tape 43 traveling through the polishing head 44, and is polished by the polishing tape 43.

Figure 11:
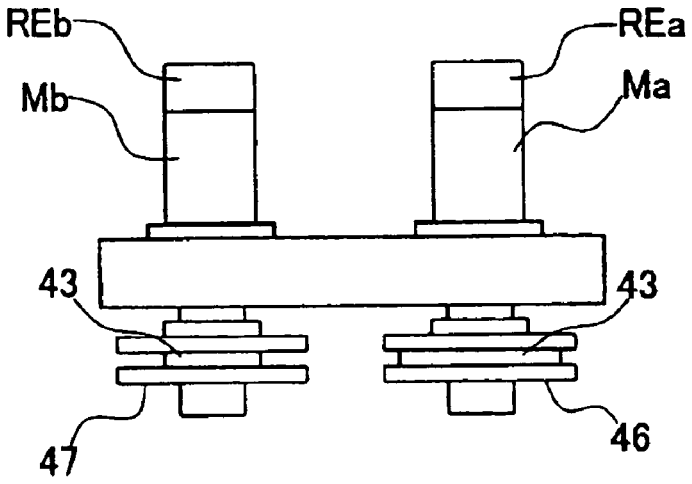
FIG. 11 is a view showing structures of a polishing-tape supply and recovery mechanism of the polishing apparatus according to the present invention.

The polishing head 44 has a first roller 41 and a second roller 42 which are arranged in parallel to each other with a certain distance therebetween. The notch of the substrate W is pressed against the polishing tape 43 lying between the first roller 41 and the second roller 42. The polishing-tape supply and recovery mechanism 45 includes, as shown in FIG. 11, the polishing-tape supply reel 46 and the polishing-tape recovery reel 47. A drive motor Ma and a drive motor Mb for rotation are coupled to the polishing-tape supply reel 46 and the polishing-tape recovery reel 47, respectively. Further, a rotary encoder REa and a rotary encoder REb are coupled to the drive motor Ma and the drive motor Mb, respectively, so as to detect respective rotation angles of the drive motor Ma and the drive motor Mb. The polishing-tape supply reel 46, the drive motor Ma, and the rotary encoder REa constitute a polishing-tape supply reel mechanism. The polishing-tape recovery reel 47, the drive motor Mb, and the rotary encoder REb constitute a polishing-tape recovery reel mechanism.

The notch polishing section 40 further includes a vertically-reciprocating mechanism for reciprocating the polishing head 44 in directions perpendicular to the surface of the substrate W, with the polishing tape 43 being pressed against the notch of the substrate W. Although not shown in the drawings, this vertically-reciprocating mechanism includes linear guides extending in a direction perpendicular to the surface of the substrate holding stage 23, and a crank shaft mechanism configured to reciprocate the polishing head 44 by motor drive.

The notch polishing section 40 further includes a polishing-head tilting mechanism for swinging the polishing head 44 with respect to the notch (in a direction as indicated by arrow R3 in FIG. 10A and FIG. 10B), with the polishing head 44 pressing the polishing tape 43 against the notch of the substrate W. This polishing-head tilting mechanism allows the polishing tape 43 to polish a front side of the notch of the substrate W. Although not shown in the drawings, the polishing-head tilting mechanism includes a shaft extending in a direction perpendicular to the traveling direction of the polishing tape 43, and a motor for rotating this shaft. This shaft is arranged in a position where the notch of the substrate W is pressed against the polishing tape 43. This shaft (which provides a swing axis of the polishing head 44) is coupled to the polishing head 44. When the shaft is rotated by the motor, the polishing tape moves from a state shown in FIG. 10A to a state shown in FIG. 10B, while being pressed against the notch. With this operation, the front side and a rear side of the notch of the substrate W can be polished.

The notch polishing section 40 further includes a nozzle 48 for supplying a polishing liquid or cooling water to the notch of the substrate W. The polishing liquid is a slurry that contains abrasive particles dispersed in water or a water-base reaction liquid.

A tape formed from a woven fabric, a nonwoven fabric, or foam material can be used as the polishing tape 43. The polishing tape 43 to be used may comprise a tape-shaped base film made of a flexible material, and a polishing layer, which is formed from abrasive particles bound by resin binder, on a surface of the base film. Examples of the abrasive particles to be used include diamond particles having an average diameter ranging from 0.1 μm to 5.0 μm and SiC particles having an average diameter of 0.1 μm. Polyester-base or polyurethane-base binder can be used as the resin binder. The base film may be made of a flexible material, such as polyester, polyurethane, or polyethylene terephthalate.

It is preferable to use, as the polishing tape 43, a tape having the polishing layer formed from the abrasive particles bound by the resin binder and to use, together with such a tape, cooling water or a polishing liquid containing abrasive particles dispersed in water. This is because polishing can be performed without using water-base reaction liquid and therefore the contamination of the substrate W and the contamination of the internal space of the housing 11 (i.e., the contamination of components in the housing 11) can be prevented.

Practically, the polishing tape 43 has a width ranging from 1 mm to 10 mm, and a length of several meters. This polishing tape 43 is wound around a cylindrical core.

Polishing of the notch of the substrate W is performed as follows. The substrate holding stage moving mechanism 60 moves the substrate W, which is held on the substrate holding stage 23, in the direction parallel to the surface of the substrate holding stage 23 to press the notch of the substrate W against the polishing tape 43 of the notch polishing section 40. In this state, the stage swinging mechanism causes the substrate holding stage 23 to swing with respect to the notch in the same plane as the surface of the semiconductor wafer W held by the substrate holding stage 23 (i.e., reciprocate the substrate holding stage 23 in the directions as indicated by the arrows R5 in FIG. 5A and FIG. 5B). In this state, the polishing head 44 may be reciprocated in the direction perpendicular to the surface of the substrate W, with the polishing tape 43 being pressed against the notch. Further, the polishing head 44 may be swung with respect to the notch (in the direction as indicated by the arrow R3 in FIG. 10A and FIG. 10B), with the polishing tape 43 being pressed against the notch.

Figure 12:
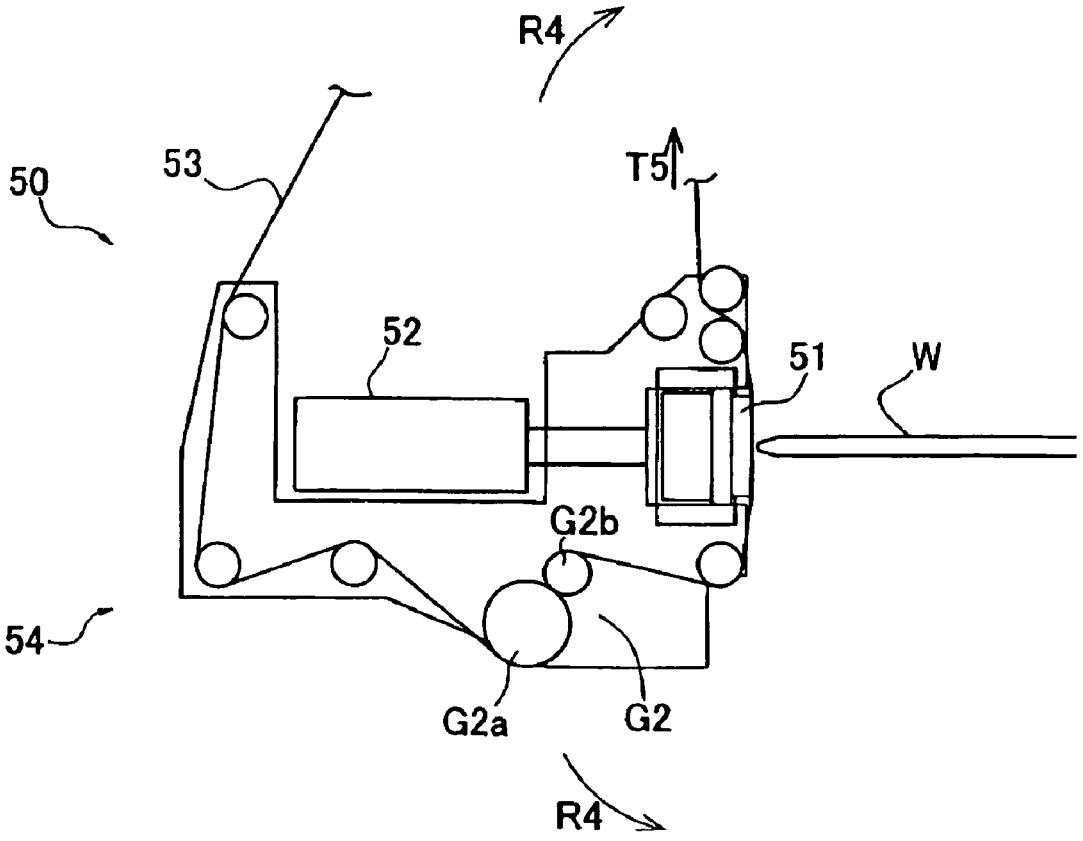
FIG. 12 is a view showing schematic structures of the polishing apparatus according to the present invention.

The bevel polishing section 50 includes, as shown in FIG. 7 and FIG. 12, a polishing head 54 having a cylinder 52 and a contact pad 51 attached to a tip of the cylinder 52. The bevel polishing section 50 further includes a polishing-tape supply and recovery mechanism 55 (see FIG. 7) configured to supply a polishing tape 53 to the polishing head 54 and to wind the polishing tape 53 supplied.

The polishing-tape supply and recovery mechanism 55 includes a polishing-tape supply reel 56 with the polishing tape 53 wound thereon, a polishing-tape recovery reel 57 for winding the polishing tape 53, supplied from the polishing-tape supply reel 56, via the contact pad 51, and a drive device (not shown in the drawings) for driving the polishing-tape recovery reel 57 so as to wind the polishing tape 53. The polishing tape 53, moving across the contact pad 51, is pressed by the contact pad 51 against the bevel of the substrate W to thereby polish the bevel.

The bevel polishing section 50 further includes a swinging mechanism for swinging the polishing head 54 with respect to the bevel in directions perpendicular to a front surface of the substrate W (in directions as indicated by arrows R4 in FIG. 12), with the polishing head 54 pressing the polishing tape 53 against the bevel of the substrate W. Although not shown in the drawings, this swinging mechanism (i.e., tilting mechanism) includes a shaft extending in a direction perpendicular to the traveling direction of the polishing tape 53, and a motor for rotating this shaft. This shaft is arranged in a position where the polishing tape 53 is pressed against the bevel of the substrate W. This shaft (which provides a swing axis of the polishing head 54) is coupled to the bevel polishing head. When the motor is energized, the polishing head 54 is swung with respect to the bevel in the directions as indicated by the arrows R4, with the polishing tape 53 being pressed against the bevel. With this operation, a front side and a rear side of the bevel of the substrate W are polished.

The bevel polishing section 50 further includes a nozzle 58 (see FIG. 7) for supplying a polishing liquid or cooling water to the bevel of the substrate W. The polishing liquid is a slurry that contains abrasive particles dispersed in water or a water-base reaction liquid.

A tape formed from a woven fabric, a nonwoven fabric, or foam material can be used as the polishing tape. Further, the polishing tape to be used may comprise a tape-shaped base film made of a flexible material, and a polishing layer, which is formed from abrasive particles bound by resin binder, on a surface of the base film. Examples of the abrasive particles to be used include diamond particles having an average diameter ranging from 0.1 μm to 5.0 μm and SiC particles having an average diameter ranging from 0.1 μm to 5.0 μm. Polyester-base or polyurethane-base binder can be used as the resin binder. The base film may be made of a flexible material, such as polyester, polyurethane, or polyethylene terephthalate.

It is preferable to use, as the polishing tape 53, a tape having the polishing layer formed from the abrasive particles bound by the resin binder and to use, together with such a tape, cooling water or a polishing liquid containing abrasive particles dispersed in water. This is because polishing can be performed without using water-base reaction liquid and therefore the contamination of the substrate W and the contamination of the internal space of the housing 11 (i.e., the contamination of components in the housing 11) can be prevented.

Practically, the polishing tape 53 has a width ranging from 1 mm to 10 mm, and a length of several tens of meters. This polishing tape 53 is wound around a cylindrical core.

The substrate W can be formed to have a desired diameter by polishing the bevel of the substrate W using the polishing tape having a polishing layer that contains abrasive particles having an average diameter of not less than 2.0 μm. Finish polishing of the bevel of the substrate W can be performed by using the polishing tape having a polishing layer that contains abrasive particles having an average diameter of less than 2.0 μm. Further, during polishing, by swinging the polishing head 54 with respect to the bevel in the directions R4 with use of the polishing tape having the polishing layer with the abrasive particles of selected size (diameter), upper and lower slopes of the substrate W can be formed to have desired angle and shape, or finish polishing can be performed on these slopes.

Polishing of the bevel of the substrate W is performed as follows. The substrate holding stage moving mechanism 60 moves substrate W, which is held by the substrate holding stage 23, in the direction parallel to the surface of the substrate holding stage 23 to press the bevel of the substrate W against the polishing tape 53. In this state, the substrate holding stage 23 is rotated by the substrate holding stage rotating mechanism.

[Detection of Outside Diameter of the Roll of the Polishing Tape 43]

Figure 10B:
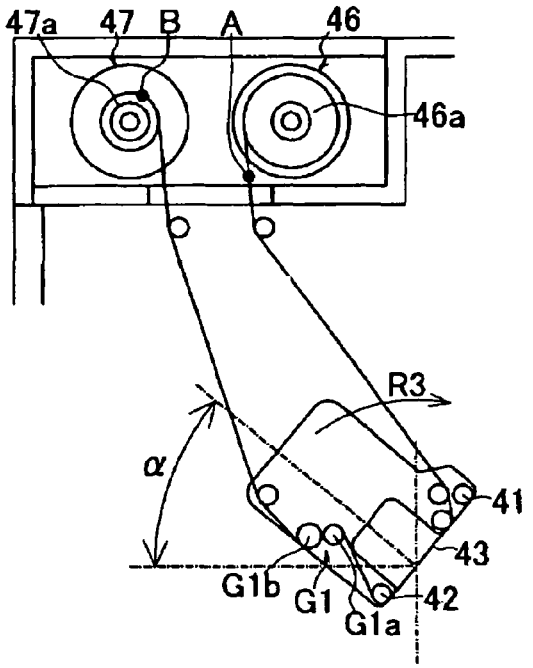

Taking the above-described notch polishing section 40 as an example, a method of detecting outside diameters of the rolls of the polishing tape 43 on the polishing-tape supply reel 46 and the polishing-tape recovery reel 47 will be described. When the polishing head 44 does not perform polishing, this polishing head 44 is tilted by an angle α from the state as shown in FIG. 10A. FIG. 10B shows the tilted polishing head 44. When the polishing head is tilted, the polishing tape 43 is drawn out from the polishing-tape supply reel 46 by a length corresponding to the tilt angle. On the other hand, the polishing tape 43 is wound by the polishing-tape recovery reel 47 by a length corresponding to the tilt angle α. As the polishing head 44 is tilted by the angle α, a point A on the polishing tape 43 shown in FIG. 10A moves to a position of the point A as shown in FIG. 10B. On the other hand, in the polishing-tape recovery reel 47, a point B shown in FIG. 10A moves to a position of the point B as shown in FIG. 10B.

Figure 13:
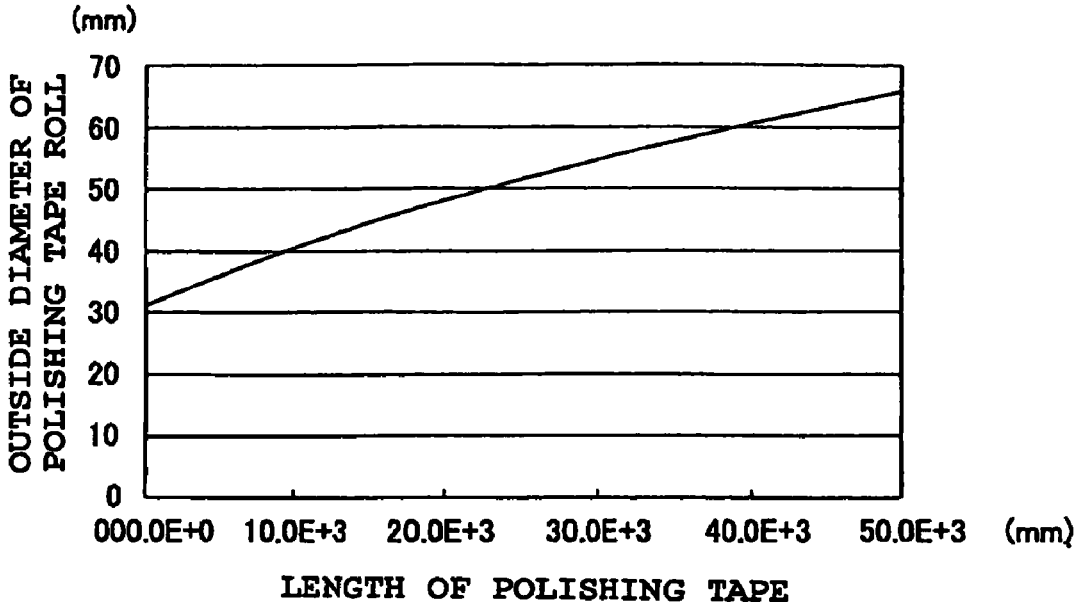
FIG. 13 is a view showing a relationship between an outside diameter of a roll of a polishing tape and a length of the polishing tape that has been pulled out.

At this time, axes of the polishing-tape supply reel 46 and the polishing-tape recovery reel 47 rotate. The rotary encoders REa and REb detect rotation angles of the polishing-tape supply reel 46 and the polishing-tape recovery reel 47, respectively, when the polishing head is tilted. If the roll of the polishing tape 43 has a large outside diameter, the rotation angle is detected to be small when the polishing head is tilted. If the roll of the polishing tape 43 has a small outside diameter, the rotation angle is detected to be large when the polishing head is tilted. FIG. 13 shows the relationship between the length of the polishing tape 43 and the outside diameter of the roll. As shown in FIG. 13, the outside diameter changes in a nonlinear manner in accordance with the length of the polishing tape wound. A slope of a graph is decreased as the length of the polishing tape wound (X axis) is increased. The slope is not the same at any of two different points on the curved line in FIG. 13.

As described above, the polishing tape 43 is wound around the core 46*a* of the polishing-tape supply reel 46 and the core 47*a* of the polishing-tape recovery reel 47. The outside diameter of the roll varies depending on the number of turns of the polishing tape. When the polishing tape 43 is drawn out by a known length, the angles of the polishing-tape supply reel 46 and the polishing-tape recovery reel 47 correspond to the slope in FIG. 13. Therefore, when the tilt angle α is constant in the tilting mechanism of the notch polishing section 40, the length of the polishing tape 43 drawn out from the polishing-tape supply reel 46 and the length of the polishing tape 43 wound by the polishing-tape recovery reel 47 are also constant even if the outside diameter of the roll of the polishing tape 43 changes. The length of the polishing tape 43 drawn out from the polishing-tape supply reel 46 and the length of the polishing tape 43 wound by the polishing-tape recovery reel 47 correspond to a length of arc of the outside diameter of the roll.

Figure 14:
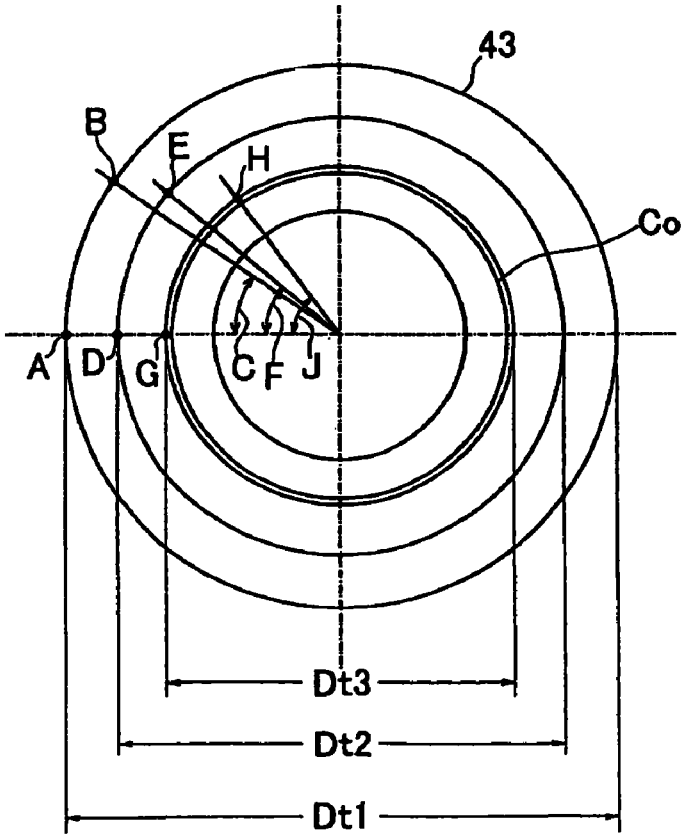
FIG. 14 is a view showing a relationship between the outside diameter of the roll of the polishing tape, the length of the polishing tape that has been pulled out, and a rotation angle.

FIG. 14 is a view showing the roll of the polishing tape 43 wound around the core Co, and simultaneously shows a large diameter (the outside diameter of the roll is Dt1) when the polishing tape 43 is not consumed, a middle diameter (the outside diameter of the roll is Dt2) when half of the polishing tape 43 is consumed, and a small diameter (the outside diameter of the roll is Dt3) when a small amount of the polishing tape 43 remains. As shown in FIG. 14, when the roll of the polishing tape 43 has the large diameter, the length of the polishing tape 43 drawn out from the roll corresponds to a length of an arc between a point A and a point B, and the rotation angle is expressed by C. When half of the polishing tape 43 is consumed, the length of the polishing tape 43 drawn out from the roll corresponds to a length of an arc between a point D and a point E, and the rotation angle is expressed by F. When the small amount of the polishing tape 43 remains, the length of the polishing tape 43 drawn out from the roll corresponds to a length of an arc between a point G and a point H, and the rotation angle is expressed by J. In this manner, when the length of the polishing tape 43 drawn out from the roll is constant, a rotational speed of the reel changes. If the length of the polishing tape 43 drawn out (i.e., the length of the arc) and the rotation angle of the reel are known, a radius to a periphery of the roll, i.e., the diameter, can be calculated. In this manner, the outside diameter of the roll of the polishing tape 43 can be calculated from the rotation angle of the polishing-tape recovery reel 47.

Operating conditions as the apparatus will now be described. There is a certain period of time between when the polishing apparatus terminates the polishing process and when the next substrate is introduced into the polishing apparatus. During this idling time (the state shown in FIG. 10A), the polishing head 44 is tilted from an angle of 0 degree to α degrees, as shown in FIG. 10B. As described above, the rotary encoder REb detects the rotation angle of the polishing-tape recovery reel 47. The polishing head 44 is returned to the idling angle, and the outside diameter of the roll of the polishing tape 43 is calculated. Then, output torques of the drive motors Ma and Mb are calculated so that a tension of the polishing tape 43 is kept at a predetermined constant value in the subsequent process. The drive motors Ma and Mb are controlled so as to generate the calculated output torques.

The polishing head 44 of the notch polishing section 40 has a polishing-tape moving mechanism, which will be discussed later. This polishing-tape moving mechanism moves the polishing tape 43 in its longitudinal direction at a very low speed during polishing, so that a new polishing surface is supplied at all times. This low-speed moving of the polishing tape 43 causes only a slight change in consumption of the polishing tape 43 and the outside diameter of the roll. Therefore, it is preferable to control the drive motors Ma and Mb so as to maintain their output torques that have been calculated just before polishing.

The polishing tape 43 is wound around the core 46*a* of the polishing-tape supply reel 46 and the core 47*a* of the polishing-tape recovery reel 47. Inside diameters and outside diameters of the cores 46*a* and 47*b* do not change. Therefore, by calculating the outside diameter of the roll of the polishing tape 43 on the polishing-tape supply reel 46, the remaining amount of the polishing tape 43 on the polishing-tape supply reel 46 can be calculated. Specifically, when the outside diameter of the roll approaches the outside diameter of the core 46*a*, it means that a small amount of the polishing tape 43 remains. Therefore, when the calculated outside diameter of the roll of the polishing tape 43 is decreased to a predetermined threshold, the notch polishing section 40 may urge the replacement of the polishing tape 43.

According to the above-described method of detecting the remaining amount of the polishing tape 43, an end mark, which was conventionally attached to the polishing tape 43, is not needed. Further, plural thresholds, which correspond to different remaining amounts of the polishing tape 43, can be set for urging the replacement of the polishing tape 43. For example, a first alarm may be raised when a relatively large amount of the polishing tape remains, e.g., the remaining amount is 8 m, a second alarm may be raised when the remaining amount is 5 m, and a third alarm may be raised when the remaining amount is 2 m. It is also possible to prepare a polishing tape 43 for replacement upon the first alarm, replace the polishing tape upon the second alarm, and apply an interlock upon the third alarm so as not to allow the polishing apparatus to perform the next polishing process. The newly prepared polishing tape is provided on a polishing-tape supply reel 46 with a roll of the new polishing tape having a predetermined outside diameter and on a polishing-tape recovery reel 47 with no roll of the polishing tape.

Next, another method of drawing out the polishing tape by a polishing-tape moving mechanism will be described. The polishing head 44 of the above-described notch polishing section 40 has a polishing-tape moving mechanism G1. This polishing-tape moving mechanism G1 is configured to move the polishing tape 43 in its longitudinal direction (i.e., send the polishing tape 43) at a constant speed from the polishing-tape supply reel 46 to the polishing-tape recovery reel 47. The polishing-tape moving mechanism G1 includes, as shown in FIG. 10A, two guide rollers G1*a* and G1*b* which hold the polishing tape 43 therebetween. One of the guide rollers G1*a* and G1*b* is rotated by a drive source to thereby move the polishing tape 43 at a constant speed.

The rotation angle of the polishing-tape supply reel 46 is detected before moving forward of the polishing tape 43 is started. Next, the polishing tape 43 is moved by a predetermined length, and the angle of the polishing-tape supply reel 46 is detected. In this manner, the rotation angle is detected before and after the polishing tape 43 is moved. The outside diameter of the roll of the polishing tape 43 is calculated from the detected rotation angles. Then, the polishing-tape moving mechanism G1 moves the polishing tape 43 in the opposite direction, i.e., returns the polishing tape 43 to its original tape position. With this operation, the polishing tape 43 can be used without waste for the next processing of the substrate W. In this example, the polishing-tape moving mechanism G1 serves as a polishing-tape drawing-out mechanism.

Both the above-described operations of drawing out the polishing tape 43 by the tilt motion of the polishing head 44 and the operations of drawing out the polishing tape 43 by the tape moving mechanism G1 are preferably performed in an interval between the polishing processes. More specifically, after the completion of the polishing process and before entry of the next substrate W into the apparatus, a series of the above-mentioned operations is performed, and the outside diameter of the roll of the polishing tape 43 is calculated. Since the calculation of the outside diameter of the roll of the polishing tape 43 is performed in the interval between the polishing processes, the output torques of the drive motors Ma and Mb for controlling the tension of the polishing tape 43 can be calculated from the outside diameter of the roll that has been calculated just before the polishing process. As a result, the drive motors Ma and Mb can give an accurate tension to the polishing tape 43. In addition, since the calculation of the outside diameter of the roll of the polishing tape 43 is performed in the interval between the polishing processes, the time of the polishing processes is not lengthened and therefore a throughput of the apparatus is not affected. Moreover, the remaining amount of the polishing tape can be determined from the calculated outside diameter of the roll of the polishing tape 43.

Further, the length of the polishing tape 43 supplied during polishing, i.e., the amount of the polishing tape 43 used, can be calculated from the calculated outside diameter of the roll of the polishing tape 43 on the polishing-tape supply reel 46. The length of the polishing tape 43 recovered during polishing, i.e., the amount of the polishing tape 43 recovered, can also be calculated from the calculated outside diameter of the roll of the polishing tape 43 on the polishing-tape recovery reel 47. The length of the polishing tape 43 supplied and the length of the polishing tape 43 recovered are equal to each other, as long as the polishing tape 43 does not stretch. Therefore, by comparing the length supplied and the length recovered, it is possible to determine whether the polishing tape 43 is properly supplied and recovered during polishing. This also can be used to detect the failure of the apparatus.

In the above-described example of the notch polishing section 40, the polishing-tape recovery reel 47 is rotated by the drive motor Mb to perform both drawing out of the polishing tape 43 and recovery of the polishing tape 43. Alternatively, like the tape moving mechanism G1, a pair of rollers may be provided so as to interpose the polishing tape 43 therebetween, and one of the rollers may be driven by a drive motor, while a torque of the drive motor is controlled so as to maintain a constant tension of the polishing tape 43. In this case, the polishing tape 43 may not be wound, but may be recovered by a tape recovery section, such as a recovery box. The tape drawing-out section and the tape recovery section may be provided separately.

[Detection of Outside Diameter of the Roll of the Polishing Tape 53]

In the above-described bevel polishing section 50, detection of the outside diameters of the rolls of the polishing tape 53 on the polishing-tape supply reel 56 and the polishing-tape recovery reel 57 is performed as follows. When the polishing head 54 does not perform polishing, this polishing head 54 is tilted from the state as shown in FIG. 12 by a predetermined angle in the directions as indicated by the arrows R4. As well as the case shown in FIG. 10B, the polishing tape 53 is drawn out from the polishing-tape supply reel 56 by a length corresponding to the angle, as the polishing head 54 is tilted. On the other hand, the polishing tape 53 is wound by the polishing-tape recovery reel 57 by a length corresponding to the angle.

At this time, axes of the polishing-tape supply reel 56 and the polishing-tape recovery reel 57 rotate. Rotary encoders (not shown) detect rotation angles of the polishing-tape supply reel 56 and the polishing-tape recovery reel 57, respectively. When the tilt angle $\alpha$ is constant in the tilting mechanism of the bevel polishing section 50, the length of the polishing tape 53 wound by the polishing-tape recovery reel 57 is also constant. Therefore, the outside diameter of the roll of the polishing tape 53 can be calculated from the rotation angle of the polishing-tape recovery reel 57.

Operating conditions as the apparatus will now be described. There is a certain period of time between when the processing apparatus terminates the polishing process and when the next substrate is introduced into the apparatus. During this idling time, the polishing head 54 is tilted from an angle of 0 degree to a predetermined angle, and the rotary encoder detects the rotation angle of the polishing-tape recovery reel 57. The polishing head 54 is returned to the idling angle, and the outside diameter of the roll of the polishing tape 43 is calculated. Then, output torques of drive motors that drive the polishing-tape supply reel 56 and the polishing-tape recovery reel 57 are calculated so that a tension of the polishing tape 53 is kept at a predetermined constant value in the subsequent process. The drive motors are controlled so as to generate the calculated output torques.

The polishing tape 53 is wound around a core of the polishing-tape supply reel 56 and a core of the polishing-tape recovery reel 57. Inside diameters and outside diameters of the cores do not change. Therefore, as described above, by calculating the outside diameter of the roll of the polishing tape 53 on the polishing-tape supply reel 56, the remaining amount of the polishing tape 53 on the polishing-tape supply reel 56 can be calculated. Specifically, when the outside diameter of the roll approaches the outside diameter of the core, it means that a small amount of the polishing tape 53 remains. Therefore, when the outside diameter of the roll of the polishing tape 53 is decreased to a predetermined threshold, the bevel polishing section 50 can urge the replacement of the polishing tape 53, like the notch polishing section 40.

The polishing head 54 of the above-described bevel polishing section 50 has a polishing-tape moving mechanism G2. This polishing-tape moving mechanism G2 is configured to move the polishing tape 53 in its longitudinal direction at a constant speed from the polishing-tape supply reel 56 to the polishing-tape recovery reel 57. The polishing-tape moving mechanism G2 includes, as shown in FIG. 12, two guide rollers G2*a* and G2*b* which hold the polishing tape 53 therebetween. One of the guide rollers G2*a* and G2*b* is rotated by a drive source to thereby move the polishing tape 53 at a constant speed.

The rotation angle of the polishing-tape supply reel 56 is detected before moving forward of the polishing tape 53 is started. Next, the polishing tape 53 is moved by a predetermined length, and the angle of the polishing-tape supply reel 56 is detected. In this manner, the rotation angle is detected before and after the polishing tape 53 is moved. The outside diameter of the roll of the polishing tape 53 is calculated from the detected rotation angles. Then, the polishing-tape moving mechanism G2 moves the polishing tape 53 in the opposite direction, i.e., returns the polishing tape 53 to its original tape position. With this operation, the polishing tape 53 can be used without waste for the next processing of the substrate W. In this example, the polishing-tape moving mechanism G2 serves as a polishing-tape drawing-out mechanism.

Both the above-described operations of drawing out the polishing tape 53 by the tilt motion of the polishing head 54 and the operations of drawing out the polishing tape 53 by the tape moving mechanism G2 are preferably performed in an interval between the polishing processes. More specifically, after the completion of the polishing process and before entry of the next substrate W into the apparatus, a series of the above-mentioned operations is performed, and the outside diameter of the roll of the polishing tape 53 is calculated. Since the calculation of the outside diameter of the roll of the polishing tape 53 is performed in the interval between the polishing processes, the output torques of the drive motors for controlling the tension of the polishing tape 53 can be calculated from the outside diameter of the roll that has been calculated just before the polishing process. As a result, the drive motors can give an accurate tension to the polishing tape 53. In addition, since the calculation of the outside diameter of the roll of the polishing tape 53 is performed in the interval between the polishing processes, the time of the polishing processes is not lengthened and therefore a throughput of the apparatus is not affected. Moreover, the remaining amount of the polishing tape can be determined from the calculated outside diameter of the roll of the polishing tape 53.

Further, the length of the polishing tape 53 supplied during polishing, i.e., the amount of the polishing tape 53 used, can be calculated from the calculated outside diameter of the roll of the polishing tape 53 on the polishing-tape supply reel 56. The length of the polishing tape 53 recovered during polishing, i.e., the amount of the polishing tape 53 recovered, can also be calculated from the calculated outside diameter of the roll of the polishing tape 53 on the polishing-tape recovery reel 57. The length of the polishing tape 53 supplied and the length of the polishing tape 53 recovered are equal to each other, as long as the polishing tape 53 does not stretch. Therefore, by comparing the length supplied and the length recovered, it is possible to determine whether the polishing tape 53 is properly supplied and recovered during polishing. This also can be used to detect the failure of the apparatus, like the above-mentioned notch polishing section 40.

In the above-described example of the bevel polishing section 50, the polishing-tape recovery reel 57 is rotated by the drive motor (not shown) to perform both drawing out of the polishing tape 53 and recovery of the polishing tape 53. Alternatively, like the tape moving mechanism G2, a pair of rollers may be provided so as to interpose the polishing tape 53 therebetween, and one of the rollers may be driven by a drive motor, while a torque of the drive motor is controlled so as to maintain a constant tension of the polishing tape 53. In this case, the polishing tape 53 may not be wound, but may be recovered by a tape recovery section, such as a recovery box. The tape drawing-out section and the tape recovery section may be provided separately.

Figure 15:
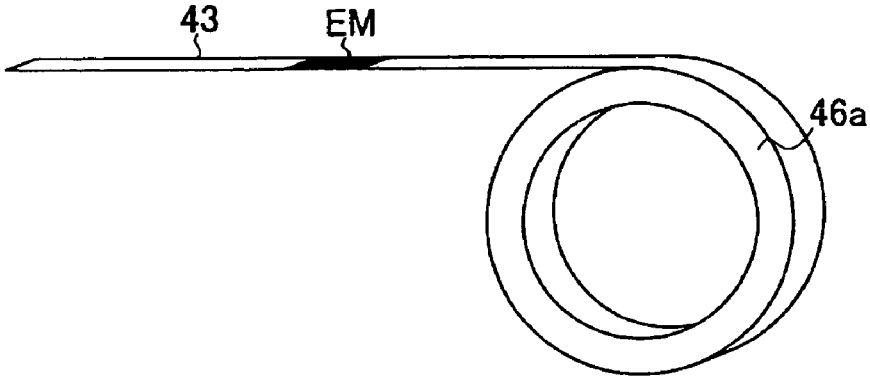
FIG. 15 is a view showing an end mark provided on the polishing tape.
Figure 16:
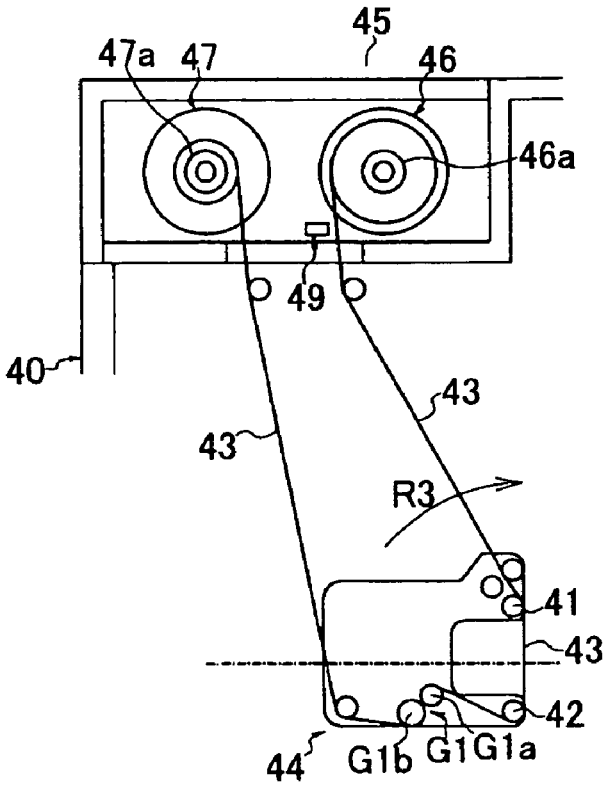
FIG. 16 is a view showing an example in which an optical sensor for detecting the end mark is provided near a polishing-tape supply reel of a notch polishing section.

Next, an embodiment using the polishing-tape drawing-out mechanism of the above-described notch polishing section 40 and an EM end mark provided on the polishing tape 43 will be described. As shown in FIG. 15, the end mark EM is provided on the polishing tape 43 at a position where a few meters of the polishing tape 43 remains. This end mark EM is constituted by a black-colored adhesive tape or printed on the polishing tape 43. As shown in FIG. 16, an optical sensor 49 is provided so as to face the polishing tape that has just been drawn out from the polishing-tape supply reel 46 toward the polishing head 44. This optical sensor 49 is a reflex sensor that emits a laser light to the polishing tape 43 and detects a quantity of the reflected light. The optical sensor 49 detects the quantity of the reflected light from the surface, on which the end mark EM is attached, of the polishing tape 43 itself and the quantity of the reflected light from the black-colored end mark EM to thereby detect the presence of the end mark EM.

Conventionally, the detection of the end mark EM is performed during polishing. In this embodiment, before or after the polishing process, the polishing-tape moving mechanism G1 moves the polishing tape 43 by a predetermined length or the polishing head 44 is tilted to draw out the polishing tape 43 by a predetermined length, as shown in FIG. 10B. The optical sensor 49 detects whether the end mark EM is present on the longitudinal region of the polishing tape 43 that has been drawn out. This method is advantageous in a case where a length of the polishing tape to be used per workpiece, i.e., a consumption of the polishing tape 43 per process, is shorter than the length of the polishing tape drawn out. According to this method, because the polishing tape 43 is not drawn out during polishing, but is drawn out before or after the polishing process, the end mark EM can be detected regardless of the polishing operations or the polishing-tape length that could change depending on polishing conditions. Therefore, repeatability of the detection of the end mark EM is improved.

In the above-described structure and method, the position of the end mark EM on the polishing tape 43 is determined in advance. In view of this, the position of the end mark EM detected may be compared with the outside diameter and the remaining amount of the polishing tape 43 on the polishing-tape supply reel 46 calculated from the length of the polishing tape 43 and the rotation angle of the polishing-tape supply reel 46. From the results of this comparison, it is possible to compensate a calculating formula for use in calculating the remaining amount, in order to bring the calculated value closer to the actual value. Further, when the calculated value is greatly different from the detected position of the end mark EM, it is possible to alert a user that a failure has occurred.

As described above, since the end mark EM is provided on the polishing tape 43 at a position where several meters remain, several substrates W can be polished, even after the optical sensor 49 detects the end mark EM. Therefore, it is not necessary to terminate the polishing process immediately after the optical sensor 49 detects the end mark EM in the predetermined longitudinal region of the polishing tape 43 drawn out before or after the polishing process. In this embodiment, the polishing-tape drawing-out mechanism of the notch polishing section 40 and the end mark EM on the polishing tape 43 are used. Although not shown in the drawings, it should be understood that an embodiment using the polishing-tape drawing-out mechanism of the bevel polishing section 50 and an end mark on the polishing tape 53 can also be made.

Another example of applications of the method of calculating the remaining amount of the polishing tape will be described.

Figure 17:
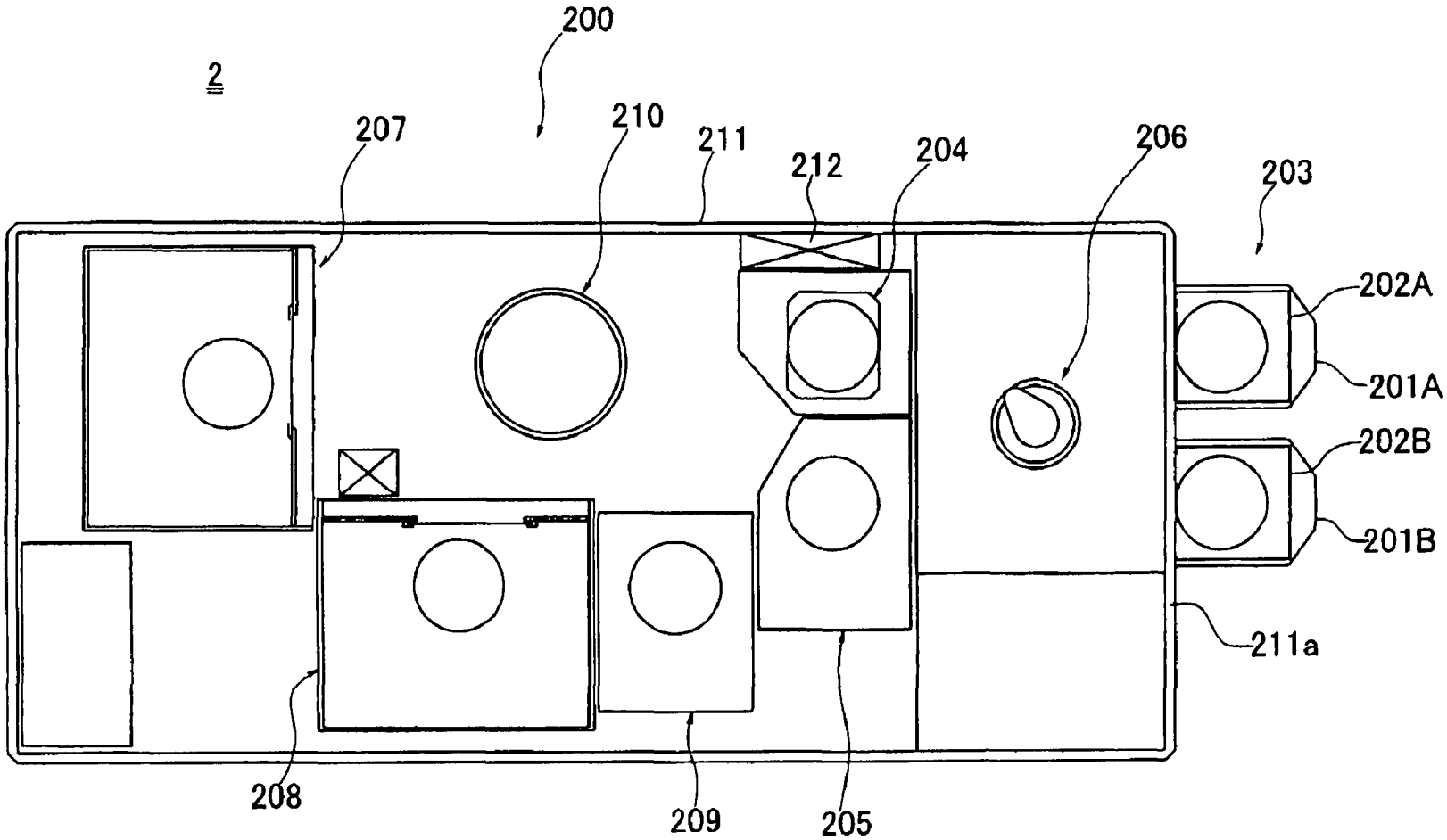
FIG. 17 is a view showing schematic structures of the substrate processing apparatus according to the present invention.

FIG. 17 is a schematic plan view showing a whole structure of a substrate processing apparatus. A substrate processing apparatus 200 in FIG. 17 includes a load and unload port 203 having wafer supply-recovery units 201A and 201B, a measuring unit 204 for measuring a shape of a periphery of a wafer, a first transfer robot 206 for transferring a wafer mainly between the load and unload port 203, the measuring unit 204, and a cleaning and drying unit 205 which will be described below, a first bevel polishing unit 207 and a second bevel polishing unit 208 for polishing a periphery of a wafer, a cleaning unit 209 for cleaning the polished wafer, the cleaning and drying unit 205 for cleaning and drying the cleaned wafer, and a second transfer robot 210 for transferring a wafer mainly between the first and second bevel polishing units 207 and 208, the cleaning unit 209, and the cleaning and drying unit 205. Although not shown in the drawings, the substrate processing apparatus 200 further includes a polishing-condition determining device for determining polishing conditions in the first and second bevel polishing units 207 and 208 based on the measurement result of the wafer in the measuring unit 204.

The above-described units of the substrate processing apparatus 200 are arranged in a housing 211 installed in a clean room 2. An internal space of the clean room 2 and an internal space of the substrate processing apparatus 200 are partitioned by the housing 211. A clean air is introduced into the housing 211 through an air-suction unit 211 that is provided on an upper portion of the housing 211, and the air is discharged to the exterior of the housing 211 through an air outlet (not shown) that is provided on a lower portion of the housing 211, so that a down flow of the clean air is formed in the housing 211. With this flow of the clean air, internal pressure and the flow of the air in the substrate processing apparatus 200 are maintained in optimal conditions for substrate processing. All the units in the housing 211 are disposed in casings, respectively. Internal pressure and air flow in these casings of the units are also maintained in optimal conditions for substrate processing.

The load and unload port 203 is installed on an outer surface of a sidewall 211*a* that is located next to the first transfer robot 206. The two wafer supply-recovery units 201A and 201B, which are referred to as FOUP (Front Opening Unified Pod), are arranged in parallel to each other. Wafers are supplied to and recovered from the substrate processing apparatus via these wafer supply-recovery units 201A and 201B. When a wafer cassette (wafer carrier) 202A or 202B having plural wafers therein is placed onto one of the wafer supply-recovery units 201A and 201B, a lid of the wafer cassette 202A or 202B is opened automatically, and a window (not shown) on the sidewall 211*a* is opened, whereby the first transfer robot 206 can remove a wafer in the wafer cassette 202A or 202B and transfer the wafer into the substrate processing apparatus 200.

Because the two wafer supply-recovery units 201A and 201B are arranged in parallel to each other in the load and unload port 203, wafers can be transferred simultaneously to and from these two wafer supply-recovery units 201A and 201B. Therefore, an operating rate of the substrate processing apparatus 200 can be improved. Specifically, after wafers in one of the wafer cassettes 202A and 202B on one of the wafer supply-recovery units 201A and 201B are transferred into the substrate processing apparatus 200, wafers in another of the wafer cassettes 202A and 202B on another of the wafer supply-recovery units 201A and 201B can be transferred successively into the substrate processing apparatus 200. During this transferring of the wafers, the vacant wafer cassette 202A or 202B can be replaced. In this manner, the wafers can be transferred successively into the substrate processing apparatus 200.

As described above, the bevel polishing section 50 can calculate the remaining amount of the polishing tape 53. In the substrate processing apparatus as shown in FIG. 17, each of the first and second bevel polishing units 207 and 208 includes the above-described bevel polishing section 50. Therefore, from the remaining amount of the polishing tape 53 and the polishing time of the bevel of the wafers in the substrate processing apparatus and the amount of the polishing tape 53 that has been moved, the bevel polishing section 50 can calculate the number of wafers the substrate processing apparatus 200 can process without replacement of the polishing tape 53. The substrate processing apparatus 200 may alert that it cannot process the wafers more than the numbers calculated, and the substrate processing apparatus 200 can urge the user to replace the polishing tape 53.

The workpiece may be a semiconductor wafer. In this case, twenty-five wafers are typically processed as one cassette. The wafer cassettes 202A and 202B are placed onto the wafer supply-recovery units 201A and 201B of the load and unload port 203 of the substrate processing apparatus 200. Processing conditions for the wafers in these wafer cassettes 202A and 202B are registered in the substrate processing apparatus 200. The processing conditions include a polishing time and an amount of the polishing tape 53 to be moved. Therefore, by calculating the remaining amount of the polishing tape 53 in the bevel polishing section 50, it is possible to determine whether all the wafers in the wafer cassettes 202A and 202B loaded can be polished by the bevel polishing section 50 without replacing the polishing tape 53.

While the substrate processing apparatus using the bevel polishing section 50 has been described with reference to FIG. 17, the substrate processing apparatus using the notch polishing section 40 can be provided as well. The bevel polishing section 50 can calculate the remaining amount of the polishing tape 53. In this case also, from the remaining amount of the polishing tape 43 in the notch polishing section 40 and the polishing time of the bevel of the wafers in the substrate processing apparatus and the amount of the polishing tape 43 that has been moved, the notch polishing section 40 can calculate the number of wafers the substrate processing apparatus can process without replacement of the polishing tape 43. The substrate processing apparatus can alert that it cannot process the wafers more than the numbers calculated, and the substrate processing apparatus can urge the user to replace the polishing tape 43.

Certain preferred embodiments of the present invention have been shown and described in detail. However, the present invention is not limited to the above-describe embodiments. It should be understood that various changes and modifications may be made without departing from the scope of claims for patent and the scope of the technical concept described in the specification and drawings. Any shapes, structures, and materials, which are not described directly in the specification and drawings, may be within the scope of the technical concept of the present invention, as long as they have the same effects of the present invention.

INDUSTRIAL APPLICABILITY

The present invention is applicable to a polishing apparatus and a polishing method for polishing a periphery of a substrate, such as a semiconductor wafer, using a polishing tape, and also applicable to a processing apparatus using such a polishing apparatus.

The invention claimed is:

1. A polishing apparatus for polishing a workpiece by providing relative movement between a polishing tape and the workpiece, said apparatus comprising:

a polishing-tape supply reel;

a polishing head;

a polishing-tape drawing-out mechanism; and a polishing-tape supply and recovery mechanism configured to recover the polishing tape from said polishing-tape supply reel via said polishing head, the polishing tape being brought into contact with the workpiece while traveling through said polishing head, wherein said polishing-tape supply and recovery mechanism includes a motor adapted to apply a torque to said polishing-tape supply reel so as to exert a predetermined tension on the polishing tape traveling through said polishing head, and a rotation angle detector adapted to detect a rotation angle of said polishing-tape supply reel.

2. The polishing apparatus according to claim 1, further comprising:

a polishing-tape recovery reel for winding and recovering the polishing tape drawn out by said polishing-tape drawing-out mechanism.

3. A processing apparatus for performing several processes including polishing of a workpiece, said apparatus comprising:

a workpiece holding stage disposed in a housing and configured to hold a workpiece; and at least one polishing apparatus for polishing a periphery of the workpiece according to claim 2.

4. A processing apparatus for performing several processes including polishing of a workpiece, said apparatus comprising:

a workpiece holding stage disposed in a housing and configured to hold a workpiece; and at least one polishing apparatus for polishing a periphery of the workpiece according to claim 1.

5. A polishing method, comprising:

drawing out a polishing tape from a polishing-tape supply reel by a predetermined length;

bringing the polishing tape into contact with a workpiece while the polishing tape travels through a polishing head;

providing relative movement between the polishing tape and the workpiece to polish the workpiece;

recovering the polishing tape via the polishing head;

before and after said drawing out of the polishing tape by the predetermined length, detecting a rotation angle of the polishing-tape supply reel; and calculating from the rotation angle an outside diameter of a roll of the polishing tape on the polishing-tape supply reel.

6. The polishing method according to claim 5, wherein said drawing out of the polishing tape by the predetermined length and said calculating of the outside diameter of the roll of the polishing tape on the polishing-tape supply reel are performed before or after said polishing of the workpiece.

7. The polishing method according to claim 6, further comprising:

from the calculated outside diameter of the roll of the polishing tape on the polishing-tape supply reel and the rotation angle of the polishing-tape supply reel detected before and after said polishing of the workpiece, determining a length of the polishing tape supplied and a length of the polishing tape recovered before or after said polishing of the workpiece.

8. The polishing method according to claim 6, further comprising:

based on the calculated outside diameter of the roll of the polishing tape on the polishing-tape supply reel, controlling a torque of a motor that drives the polishing-tape supply reel and controlling a torque of a motor that drives the polishing-tape drawing-out mechanism so as to control a tension exerted on the polishing tape.

9. The polishing method according to claim 6, further comprising:

calculating a remaining amount of the polishing tape from the calculated outside diameter of the roll of the polishing tape on the polishing-tape supply reel.

10. The polishing method according to claim 5, further comprising:

based on the calculated outside diameter of the roll of the polishing tape on the polishing-tape supply reel, controlling a torque of a motor that drives the polishing-tape supply reel and controlling a torque of a motor that drives the polishing-tape drawing-out mechanism so as to control a tension exerted on the polishing tape.

11. The polishing method according to claim 5, further comprising:

calculating a remaining amount of the polishing tape from the calculated outside diameter of the roll of the polishing tape on the polishing-tape supply reel.

12. The polishing method according to claim 11, further comprising:

from the calculated remaining amount of the polishing tape, calculating the number of workpieces that can be polished without replacement of the polishing tape, so as not to polish the workpieces more than the number calculated.

* * * * *